US012704036B2

(12) United States Patent
Zakharia et al.

(10) Patent No.: US 12,704,036 B2
(45) Date of Patent: Aug. 11, 2026

(54) PLUGGING ASSEMBLIES FOR PLUGGING CASED WELLBORES

(71) Applicant: G&H Diversified Manufacturing LP, Houston, TX (US)

(72) Inventors: Steven Zakharia, Houston, TX (US); Joshua Magill, Cypress, TX (US); Benjamin Knight, Katy, TX (US); Christian Atilano, Houston, TX (US)

(73) Assignee: G&H Diversified Manufacturing LP, Houston, TX (US)

( * ) Notice: Subject to any disclaimer, the term of this patent is extended or adjusted under 35 U.S.C. 154(b) by 0 days.

(21) Appl. No.: 19/193,618

(22) Filed: Apr. 29, 2025

(65) Prior Publication Data

US 2025/0257622 A1 Aug. 14, 2025

Related U.S. Application Data

(63) Continuation of application No. 18/211,508, filed on Jun. 19, 2023, now Pat. No. 12,312,887, which is a continuation-in-part of application No. 17/687,389, filed on Mar. 4, 2022, now Pat. No. 11,708,731.

(60) Provisional application No. 63/156,473, filed on Mar. 4, 2021.

(51) Int. Cl.

| | |
|---|---|
| ***E21B 23/06*** | (2006.01) |
| ***E21B 33/127*** | (2006.01) |
| ***E21B 33/129*** | (2006.01) |
| ***E21B 33/134*** | (2006.01) |
| *E21B 21/00* | (2006.01) |

(52) U.S. Cl.
CPC ..... *E21B 23/065* (2013.01); *E21B 33/127* (2013.01); *E21B 33/1292* (2013.01); *E21B 33/134* (2013.01); *E21B 21/003* (2013.01)

(58) Field of Classification Search
CPC ..... E21B 33/134; E21B 23/065; E21B 47/01; E21B 33/127; E21B 33/1292; E21B 21/003
See application file for complete search history.

(56) References Cited

U.S. PATENT DOCUMENTS

| | | | | |
|---|---|---|---|---|
| 5,024,270 | A * | 6/1991 | Bostick | E21B 23/065 166/134 |
| 9,810,035 | B1 * | 11/2017 | Carr | E21B 23/065 |
| 2021/0262302 | A1 * | 8/2021 | Flores Perez | E21B 23/0411 |

* cited by examiner

*Primary Examiner* — Yong-Suk (Philip) Ro
(74) *Attorney, Agent, or Firm* — Conley Rose, P.C.

(57) ABSTRACT

A toolstring for plugging and perforating a wellbore includes a perforating gun extending between an uphole end and a downhole end longitudinally opposed to the uphole end, a plugging assembly extending between an uphole end and a downhole end longitudinally opposed to the uphole end of the plugging assembly, the plug assembly including a setting tool physically attached directly to the perforating gun, the setting tool including an elongate housing extending between an uphole end and a downhole end opposite the uphole end of the housing, an open passageway extending from the uphole end to the downhole end of the housing, and wherein the setting tool further includes an elongate mandrel positioned in the open passageway and having an uphole end and a downhole end opposite the uphole end of the mandrel, and a combustion chamber located within the elongate housing for receiving an energetic charge.

7 Claims, 21 Drawing Sheets

PLUGGING ASSEMBLIES FOR PLUGGING CASED WELLBORES

CROSS-REFERENCE TO RELATED APPLICATIONS

The present application is a continuation of U.S. non-provisional patent application Ser. No. 18/211,508 filed Jun. 19, 2023, entitled "Plugging Assemblies for Plugging Cased Wellbores", which is a continuation-in-part of U.S. non-provisional patent application Ser. No. 17/687,389 filed Mar. 4, 2022, entitled "Plugging Assemblies for Plugging Cased Wellbores", now U.S. Pat. No. 11,708,731, issued Jul. 25, 2023, which claims benefit of U.S. provisional patent application No. 63/156,473 filed Mar. 4, 2021, entitled "Compact Setting Tool for a Downhole Plug," all of which are incorporated herein by reference in their entirety for all purposes.

STATEMENT REGARDING FEDERALLY SPONSORED RESEARCH OR DEVELOPMENT

Not applicable.

BACKGROUND

Subterranean wellbores may be drilled into hydrocarbon bearing, earthen formations in the interest of producing hydrocarbons from the wellbore. During completion operations for subterranean wellbores, it is conventional practice to install a tubular casing string in the wellbore and then perforate the casing string with perforating guns along the hydrocarbon bearing formation to provide many paths for formation fluids (e.g., hydrocarbons) to flow into a central passage of the casing string.

Typically, for a wellbore drilled for a long horizontal run along the hydrocarbon bearing formation, the wellbore is planned with many production zones along a horizontal run of more than a mile through what is sometimes referred to as a "tight" formation where the hydrocarbons available for production do not flow very freely. To ensure that each perforation in the casing string leads to a productive area within the hydrocarbon bearing formation, the perforations are subject to a hydraulic fracturing or "fracking" process where high pressure fluids and proppant are pumped into the casing string to enlarge and extend the fractures created by the perforation guns and to create deeper and more extensive paths to dramatically increase contact area therein and thereby productivity.

To isolate the production zones from each other, plugs are typically deployed by the fracking system on a wireline-deployed toolstring that also includes a number of perforating guns for blasting the perforations in the next adjacent production zone. It may be understood however that other devices, such as a packer, may also be used to create the desired isolation. Conventionally, plugs are set within the wellbore from the bottom end of the wireline toolstring where a standard format setting tool is attached to an adapter kit that is especially suited for the selected plug. The setting tool is powered by an energetic charge to axially compress the plug into a wider and axially shorter shape that drives slips into the casing to bite and lock the plug in place and seal the casing at the selected location in the wellbore.

It should be understood that toolstrings deployed using wireline systems have a limited length. The toolstring is typically inserted into the wellbore by a wireline through which communication with the various tools allow an operator of the wireline system to know where the toolstring is positioned within the wellbore and to adjust its downhole position and orientation. Through the wireline, the actuation of the setting tool is accomplished by an electrical signal transmitted from the surface, through the wireline, to the toolstring. Following the actuation of the setting tool to set the plug downhole, the various perforating guns are subsequently fired together or in a series where the toolstring may be moved to preferred locations within the wellbore such that the perforations formed by the perforating guns may be located in an arrangement preferred by the operator of the well.

Typically, the length of the toolstring is limited by a wireline lubricator of the wireline system which is a pipe-like device positioned at the surface over the wellbore. Typically, wireline lubricators are 40 feet (ft) to 60 ft tall with valving and a bottom sealing device, and valving and a top sealing device. The toolstring must fit fully inside of the wireline lubricator pipe and therefore, the length of the toolstring is limited by the space provided between the top and bottom sealing devices. Moreover, the toolstring must be lifted vertically into the wireline lubricator which itself has to be lifted above the vertically oriented toolstring. Thus, the length of the toolstring is limited by a vertical lifting height of the crane used to lift the wireline lubricator and toolstring up into the wireline lubricator. As an example, if a wireline lubricator is 60 ft in length and the toolstring is 50 ft in length, then the crane will be required to lift an uphole end of the toolstring to a height of more than 110 ft in order to insert the toolstring into the wireline lubricator.

Given the limitations placed on the length of the toolstring, every tool in the toolstring must justify its existence in the string with low priority tools potentially being left out. Further, the length of each individual tool of the toolstring becomes relevant under this consideration including, for example, plugs, adapter kits and setting tools. Improvements which reduce the length of individual tools and thereby minimize the length of the toolstring may allow for the inclusion of other tools that would not have otherwise fit. For example, the added tools could create more perforations in the casing for more flow paths or may reduce the number of trips required for setting up the wellbore for production of hydrocarbons.

Considering the limited length of each toolstring and having to perform a fracking process on the well between the run of each toolstring, the process of completing the wellbore and bringing into production can take several days. One big consideration is the cost per hour for these operations and minimizing efforts and personnel required during this aspect of the completion process. Reducing on site workload and reducing complexity will always be highly desired by operating companies and their contractors.

SUMMARY OF THE DISCLOSURE

An embodiment of a toolstring for plugging and perforating a wellbore including casing and extending through a subterranean formation comprises a perforating gun extending between an uphole end and a downhole end longitudinally opposed to the uphole end; and a plugging assembly extending between an uphole end and a downhole end longitudinally opposed to the uphole end of the plugging assembly, the plugging assembly comprising a setting tool physically attached directly to the perforating gun, the setting tool comprising an elongate housing extending between an uphole end and a downhole end opposite the uphole end of the housing, an open passageway extending from the uphole end to the downhole end of the housing, and wherein the setting tool further includes an elongate mandrel positioned in the open passageway and having an uphole end and a downhole end opposite the uphole end of the mandrel, and a combustion chamber located within the elongate housing for receiving an energetic charge; and a plug attached to the setting tool, the plug comprising an elongate core with an uphole end and a downhole end opposite the uphole end of the core, a sealing element disposed fully around the core to seal against the casing, an anchoring system for anchoring the plug to the casing in a fixed position, a compression fitting disposed around the core at or near the uphole end of the core, a nose at the downhole end of the core, wherein the sealing element and the anchoring system have an initial configuration having an outer maximum run in diameter, and an expanded configuration having an outer maximum expanded diameter that is greater than the maximum run-in diameter. In some embodiments, the toolstring further comprises an adapter kit physically attached directly to the setting tool and the plug physically attached directly to the adapter kit. In some embodiments, the plug is physically attached directly to the setting tool. In certain embodiments, a downhole end of the perforating gun is mechanically connected to an uphole end of the setting tool. In certain embodiments, the perforating gun comprises an outer housing, and a downhole end of the housing of the perforating gun is mechanically connected to the uphole end of the mandrel of the setting tool. In some embodiments, the perforating gun comprises an outer housing, and a downhole end of the housing of the perforating gun is threadably connected to the uphole end of the mandrel of the setting tool. In some embodiments, the setting tool comprises a setting tool initiator contacting the energetic charge, the setting tool initiator configured to ignite the energetic charge to pressurize the combustion chamber in response to receiving a setting tool firing signal. In certain embodiments, the setting tool comprises a setting tool initiator received in an internal passage of the mandrel, the setting tool initiator configured to ignite the energetic charge to pressurize the combustion chamber in response to receiving a setting tool firing signal. In certain embodiments, the setting tool comprises a setting tool initiating cartridge comprising a cartridge chassis having an internal receptacle, a setting tool initiator, an electrical switch communicatively coupled to the setting tool initiator, wherein the setting tool initiator and electrical switch are each received in the internal receptacle of the cartridge chassis whereby the setting tool initiator and electrical switch axially overlap. In some embodiments, the setting tool initiating cartridge comprises a sacrificial electrical conductor electrically connected between the electrical switch and an uphole end of the toolstring, wherein a portion of the sacrificial electrical conductor is hydraulically exposed to a downhole end of the setting tool initiator so as to be severed electrically upon activation of the setting tool initiator. In some embodiments, the setting tool initiating cartridge comprises a setting tool pressure bulkhead connected to an uphole end of the cartridge chassis. In certain embodiments, the setting tool initiating cartridge comprises an insulating housing and an initiator electrical contact received in the insulating housing and connected to the setting tool initiator, wherein the insulating housing comprises one or more radial ports providing access to the initiator electrical contact. In certain embodiments, the setting tool initiating cartridge is received in and secured to an internal passage of the setting tool.

An embodiment of a toolstring for plugging and perforating a wellbore including casing and extending through a subterranean formation comprises a perforating gun extending between an uphole end and a downhole end longitudinally opposed to the uphole end; and a plugging assembly attached to the perforating gun and extending between an uphole end and a downhole end longitudinally opposed to the uphole end of the plugging assembly, the plugging assembly comprising a setting tool comprising an elongate housing extending between an uphole end and a downhole end opposite the uphole end of the housing, an open passageway extending from the uphole end to the downhole end of the housing, an elongate mandrel positioned in the open passageway and having an uphole end and a downhole end opposite the uphole end of the mandrel, a combustion chamber located within the elongate housing, an energetic charge located in an internal passage of the mandrel, and a setting tool initiator located in the internal passage of the mandrel and configured to ignite the energetic charge to pressurize the combustion chamber in response to receiving a setting tool firing signal; and a plug attached to the setting tool, the plug comprising an elongate core with an uphole end and a downhole end opposite the uphole end of the core, a sealing element disposed fully around the core to seal against the casing, an anchoring system for anchoring the plug to the casing in a fixed position, a compression fitting disposed around the core at or near the uphole end of the core, a nose at the downhole end of the core, wherein the sealing element and the anchoring system have an initial configuration having an outer maximum run in diameter, and an expanded configuration having an outer maximum expanded diameter that is greater than the maximum run-in diameter. In some embodiments, the setting tool initiator contacts the energetic charge. In some embodiments, the setting tool initiator comprises an electrical switch and an initiator communicatively coupled to the electrical switch. In certain embodiments, the electrical switch comprises a digitally addressable switch. In certain embodiments, the initiator is ballistically coupled to the energetic charge. In some embodiments, the energetic charge comprises an outer housing, a pair of primers located at opposing longitudinal end of the energetic charge, and energetic material contained within the outer housing of the energetic charge and located longitudinally between the pair of primers. In some embodiments, the setting tool initiator is ballistically coupled to one of the pair of primers of the energetic charge. In certain embodiments, the setting tool comprises a setting tool initiating cartridge comprising a cartridge chassis having an internal receptacle, the setting tool initiator, an electrical switch communicatively coupled to the setting tool initiator, wherein the setting tool initiator and electrical switch are each received in the internal receptacle of the cartridge chassis whereby the setting tool initiator and electrical switch axially overlap. In certain embodiments, the setting tool initiating cartridge comprises a sacrificial electrical conductor electrically connected between the electrical switch and an uphole end of the toolstring, wherein a portion of the sacrificial electrical conductor axially aligns with a downhole end of the setting tool initiator. In some embodiments, the setting tool initiating cartridge comprises a setting tool pressure bulkhead connected to an uphole end of the cartridge chassis. In some embodiments, the setting tool initiating cartridge comprises an insulating housing and an initiator electrical contact received in the insulating housing and connected to the setting tool initiator, wherein the insulating housing comprises one or more radial ports providing access to the initiator electrical contact.

An embodiment of a method for operating a toolstring for plugging and perforating a wellbore extending through a subterranean formation comprises (a) inserting an energetic charge into an internal passage of a setting tool of the toolstring; (b) ballistically coupling a setting tool initiator to the energetic charge, the setting tool initiator configured to ignite the energetic charge in response to receiving a setting tool firing signal; and (c) mechanically connecting a perforating gun of the toolstring directly to the setting tool. In certain embodiments, the internal passage of the setting tool comprises an internal passage of a mandrel of the setting tool, the mandrel being slidably coupled to an outer housing of the setting tool. In certain embodiments, (b) comprises inserting the setting tool initiator into the internal passage of the setting tool. In some embodiments, the internal passage of the setting tool comprises an internal passage of a mandrel of the setting tool, the mandrel being slidably coupled to an outer housing of the setting tool. In some embodiments, (c) comprises mechanically connecting a downhole end of the perforating gun directly to an uphole end of the setting tool. In certain embodiments, c) comprises mechanically connecting a downhole end of an outer housing of the perforating gun directly to an uphole end of a mandrel of the setting tool. In certain embodiments, the method further comprises (d) running the toolstring into the wellbore and setting a plug of the toolstring inside the wellbore; (e) pulling the toolstring from the wellbore following (d); (f) servicing the toolstring by replacing a setting tool initiating cartridge of the toolstring, the setting tool initiating cartridge comprising the setting tool initiator, with a new setting tool initiating cartridge including a new setting tool initiator whereby the new setting tool initiating cartridge is received in the internal passage of the setting tool; and (g) running the serviced toolstring into another wellbore following (f). In some embodiments, (f) comprises discarding the setting tool initiating cartridge replaced in the serviced setting tool by the new setting tool initiating cartridge. In some embodiments, the method further comprises (d) running the toolstring into the wellbore and setting a plug of the toolstring inside the wellbore; (e) activating the setting tool of the toolstring in the wellbore whereby the energetic charge is ignited by the setting tool initiator; (f) severing an electrical connection formed along a sacrificial electrical conductor of the setting tool in response to the activation of the setting tool; and (g) providing an electrically communicated indication at the surface of the severing of the electrical connection. In certain embodiments, the method further comprises (d) extending a probe of a measurement device through a radial port formed in an insulating housing of the setting tool to contact the probe with an initiator electrical contact of the setting tool received in the insulating housing whereby an electrical property of an electrical circuit of the setting tool is detected; and (e) comparing the detected electrical property with a predefined reference electrical property of the electrical circuit.

An embodiment of a toolstring assembly kit for assembly a toolstring used for plugging and perforating a well comprises a perforating gun; a thread protector attached to a bottom set of threads; a plug setting tool with an attached plug where the plug setting tool includes a top set of threads arranged to attach to the bottom set of threads of the perforating gun; and a second thread protector attached to the top set of threads of the plug setting tool; wherein the toolstring assembly kit is arranged such that the respective thread protectors may be removed from the bottom set of threads and the top set of threads to then screw the top set of threads and the bottom set of threads together.

An embodiment of a toolstring for plugging and perforating a wellbore including casing and extending through a subterranean formation comprising a perforating gun extending between an uphole end and a downhole end longitudinally opposed to the uphole end; and a plugging assembly extending between an uphole end and a downhole end longitudinally opposed to the uphole end of the plugging assembly, the plugging assembly comprising a setting tool coupled to the perforating gun, the setting tool comprising an elongate housing extending between an uphole end and a downhole end opposite the uphole end of the housing, an open passageway extending from the uphole end to the downhole end of the housing; an elongate mandrel positioned in the open passageway and having an uphole end and a downhole end opposite the uphole end of the mandrel, and an internal passage formed within the mandrel; a combustion chamber located within the elongate housing for receiving an energetic charge; and a setting tool initiator cartridge received in the internal passage of the mandrel, the setting tool initiator cartridge comprising a cartridge chassis defining an internal receptacle, a setting tool initiator received in the internal receptacle for igniting the energetic charge; a plug attached to the setting tool, the plug comprising an elongate core with an uphole end and a downhole end opposite the uphole end of the core, a sealing element disposed fully around the core to seal against the casing, an anchoring system for anchoring the plug to the casing in a fixed position, a compression fitting disposed around the core at or near the uphole end of the core, a nose at the downhole end of the core, wherein the sealing element and the anchoring system have an initial configuration having an outer maximum run in diameter, and an expanded configuration having an outer maximum expanded diameter that is greater than the maximum run-in diameter. In certain embodiments, the toolstring further comprises a setting tool adapter physically attached between the perforating gun and the setting tool whereby an uphole end of the setting tool adapter physically contacts the downhole end of the perforating gun and a downhole end of the setting tool adapter physically contacts the uphole end of the mandrel of the setting tool. In some embodiments, the setting tool adapter comprises a box-by-pin adapter having a box connector located at the uphole end of the setting tool adapter and a pin connector located at the downhole end of the setting tool adapter. In some embodiments, the setting tool adapter comprises an electrical switch electrically connected to the setting tool initiator and configured to activate the setting tool initiator in response to receiving a firing signal. In certain embodiments, the setting tool adapter furnishes a direct electrical connection between the perforating gun and the setting tool, and wherein the setting tool initiating cartridge comprises an electrical switch received in the internal receptacle of the cartridge chassis and electrically connected to the setting tool initiator whereby the electrical switch is configured to activate the setting tool initiator in response to receiving a firing signal.

An embodiment of a method for providing an ignition propellant driven plug into a well and plugging the well for perforating and fracking comprises (a) receiving a plug set assembly and a perforating gun to a site of the well; (b) arming the perforating gun for receiving a signal and detonating a shaped charge therein to create at least one perforation in the well; (c) arming the plug set assembly for receiving a signal and igniting the propellant for setting a plug in the well; (d) attaching the plug set assembly directly to the perforating gun via a single connection; (e) attaching the perforating gun and plug set assembly attached to one another as a toolstring to a wireline system; and (f) lifting and delivering the toolstring into the well by the wireline system.

BRIEF DESCRIPTION OF THE DRAWINGS

For a detailed description of exemplary embodiments of the disclosure, reference will now be made to the accompanying drawings in which.

DETAILED DESCRIPTION

Figure 1:
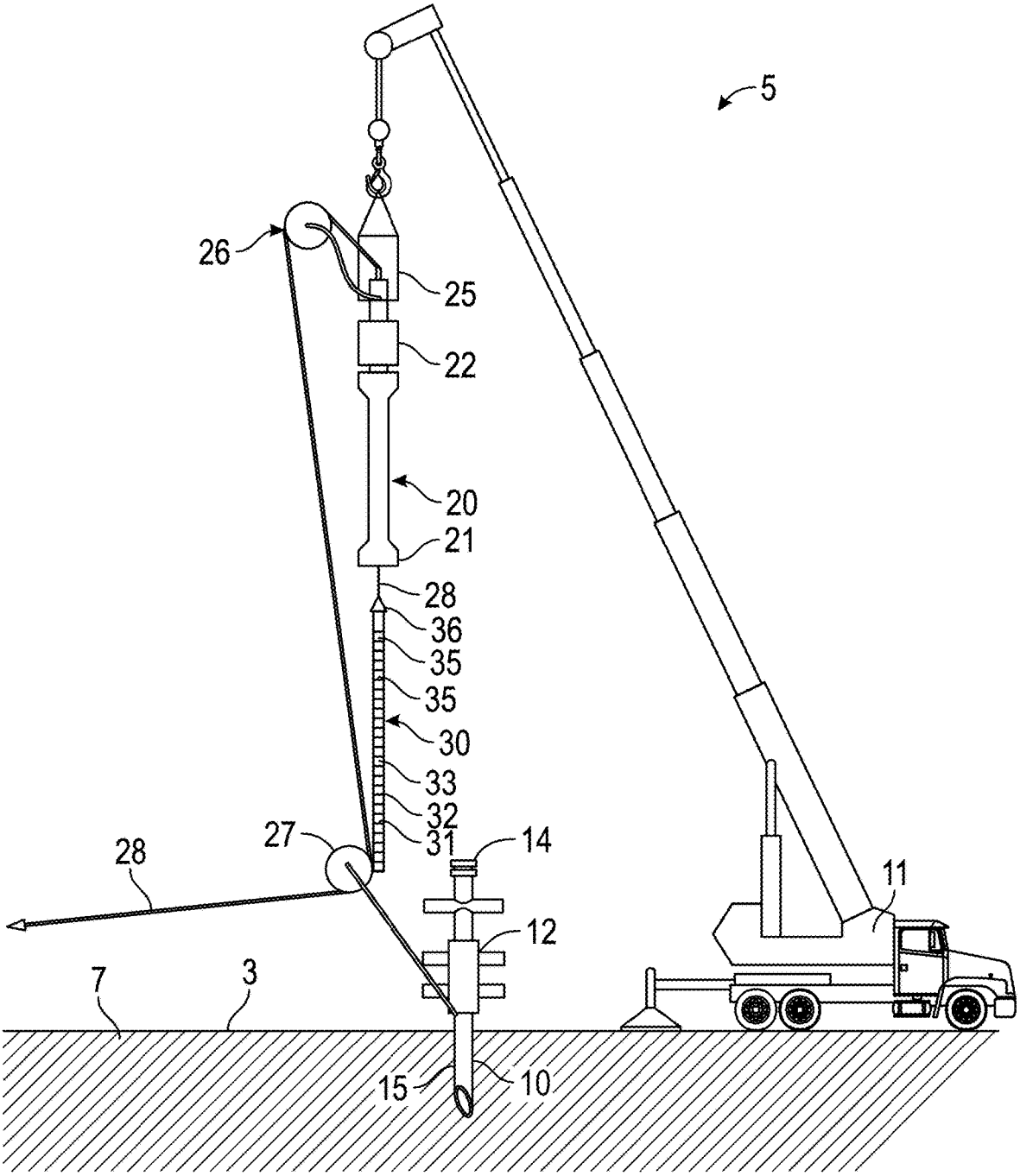
FIG. 1 (Prior Art)
FIG. 1 is an elevation view of a wellsite with a crane lifting a wireline lubricator with a toolstring suspended below about to be pulled into the wireline lubricator so that that after the lubricator is re-attached to the wellhead, the toolstring may be inserted into a wellbore.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. Further, the term "fluid," as used herein, is intended to encompass both fluids and gasses.

Referring now to FIG. 1, a wireline system 5 is shown for deploying a toolstring 30 into a cased wellbore 10 in which a casing string or casing string 15 is installed. The view shown in FIG. 1 is near the surface 7 with the cased wellbore 10 extending far into the earth and potentially into an extended generally horizontal run through a hydrocarbon bearing formation. A surface rig or crane 11 of the wireline system 5 is positioned on a pad 13 adjacent the cased wellbore 10 for lifting a wireline lubricator 20 off the top of the valve tree 12 in preparation for lifting a toolstring 30 up into the lubricator 20 to begin the process of deploying the toolstring 30 into the wellbore. Wireline 28 of the wireline system 5 is fed through the wireline lubricator 20 to pull the toolstring 30 up into the wireline lubricator 20 whereupon the wireline lubricator 20 is then attached onto the top of a valve tree 12 whereby a bottom coupling 21 of lubricator 20 sealingly connects to a coupling 14 at the top of the valve tree 12.

In the configuration shown in FIG. 1, the cased wellbore 10 is sealed by one or more valves of the valve tree 12. As is well known, pressure within cased wellbore 10 must be maintained in a controlled state at all times so that before any valve is opened, others are closed in a manner that maintains well pressure control. The position of wireline lubricator 20 is controlled by an operator of the crane 11 using a bridle 25 attached to an upper end of the wireline lubricator 20, while the position of toolstring 30 is controlled by an operator of a wireline truck (not shown) via the wireline 28. In FIG. 1, the wireline operator has reeled in the wireline 28 to lift the toolstring 30 off of the surface 7 into a vertical orientation such that an upper end of the toolstring 30 is proximal to the bottom of a wireline sealing element 22 at the bottom end of the wireline lubricator 20. The entire length of toolstring 30 must fit fully into the wireline lubricator 20 to allow the bottom coupling 21 of wireline lubricator 20 to sealingly connect to the coupling 14 of valve tree 12 to maintain well pressure control prior to insertion of the toolstring 30 into the cased wellbore 10 through the valve tree 12.

The toolstring 30 includes a number of tools that are selected by an operator of the cased wellbore 10 and which, in this example, includes a plug 31 at the bottom thereof, an adapter kit 32 and a setting tool 33 where the adapter kit 32 is connected between the plug 31 and setting tool 33. Above the setting tool 33 are a number of perforating or "perf" guns or 35 along with other tools that provide electronic communication with the setting tool 33 and the perforation guns 35 and other tools of toolstring 30 that provide the wellbore location of the toolstring 30 as well as other known functions. At the top of the toolstring 30 is a coupling device that attaches to the wireline 28. The wireline 28 extends from the wireline truck, over a pair of sheaves 26 and 27, and runs into the top of the lubricator 20 via a wireline sealing element 22 of the wireline lubricator 20. Wireline 28 is typically quite long to permit the toolstring 30 to run potentially miles through the cased wellbore 10. It may be understood that wellbores, including cased wellbore 10, extend vertically downwards from the surface 7 and then curve horizontally such at a horizontal portion of the cased wellbore 10 extends a great length (e.g., a mile or more) horizontally through a hydrocarbon bearing zone in the earthen formation.

Figure 2:
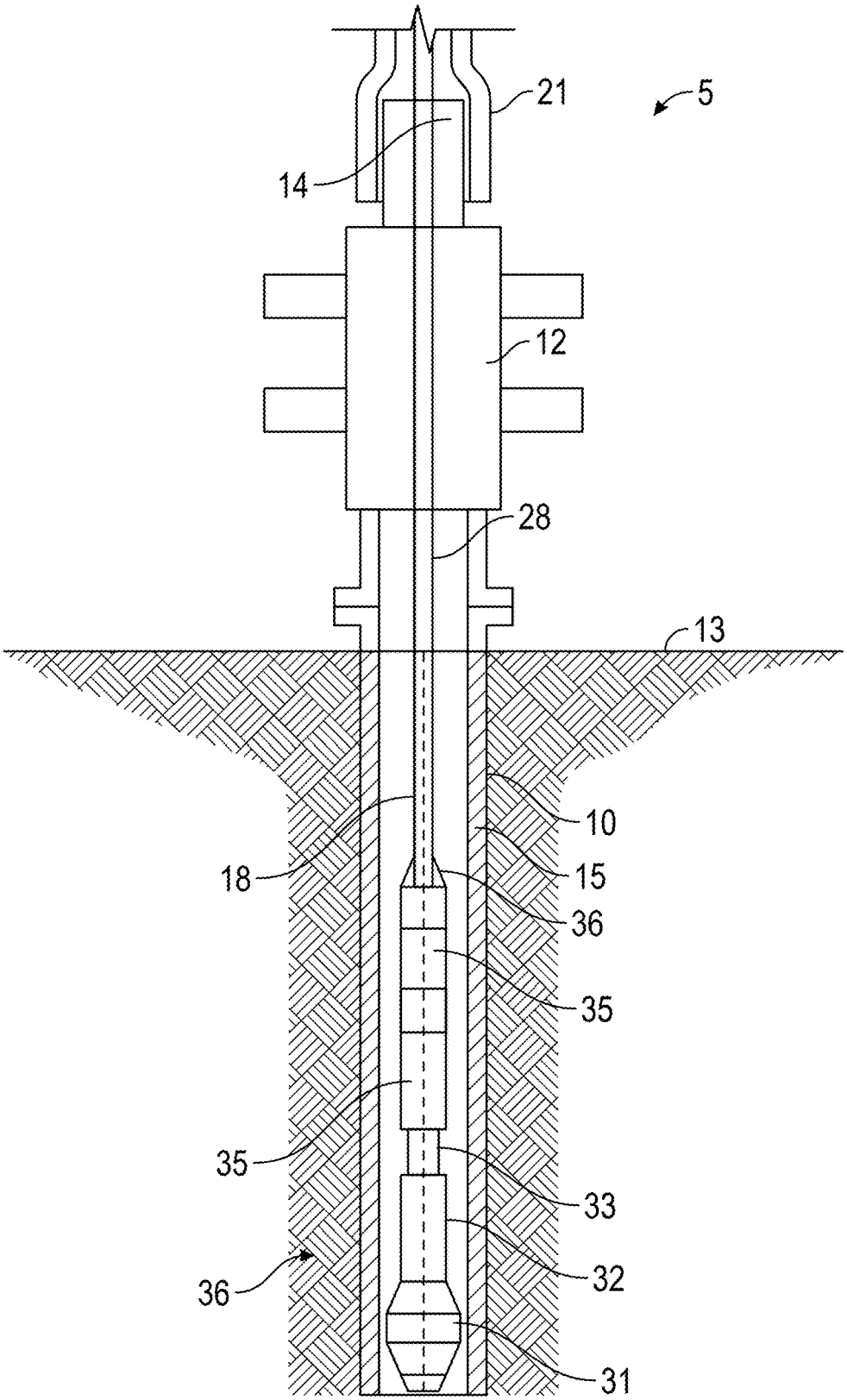
FIG. 2 (Prior Art)
FIG. 2 shows a conventional toolstring inserted into the well and progressing toward the bottom of the wellbore.

Turning briefly to FIG. 2, the toolstring 30 is shown following its insertion through and past the valves in the valve tree 12 such that the toolstring 30 is positioned inside a vertical section of the cased wellbore 10 where well pressure is under the control of the wireline sealing element 22 (not shown in FIG. 2). The toolstring 30 is lowered through the cased wellbore 10 by the wireline system 5 until the toolstring 30 reaches a predetermined depth.

Figure 3:
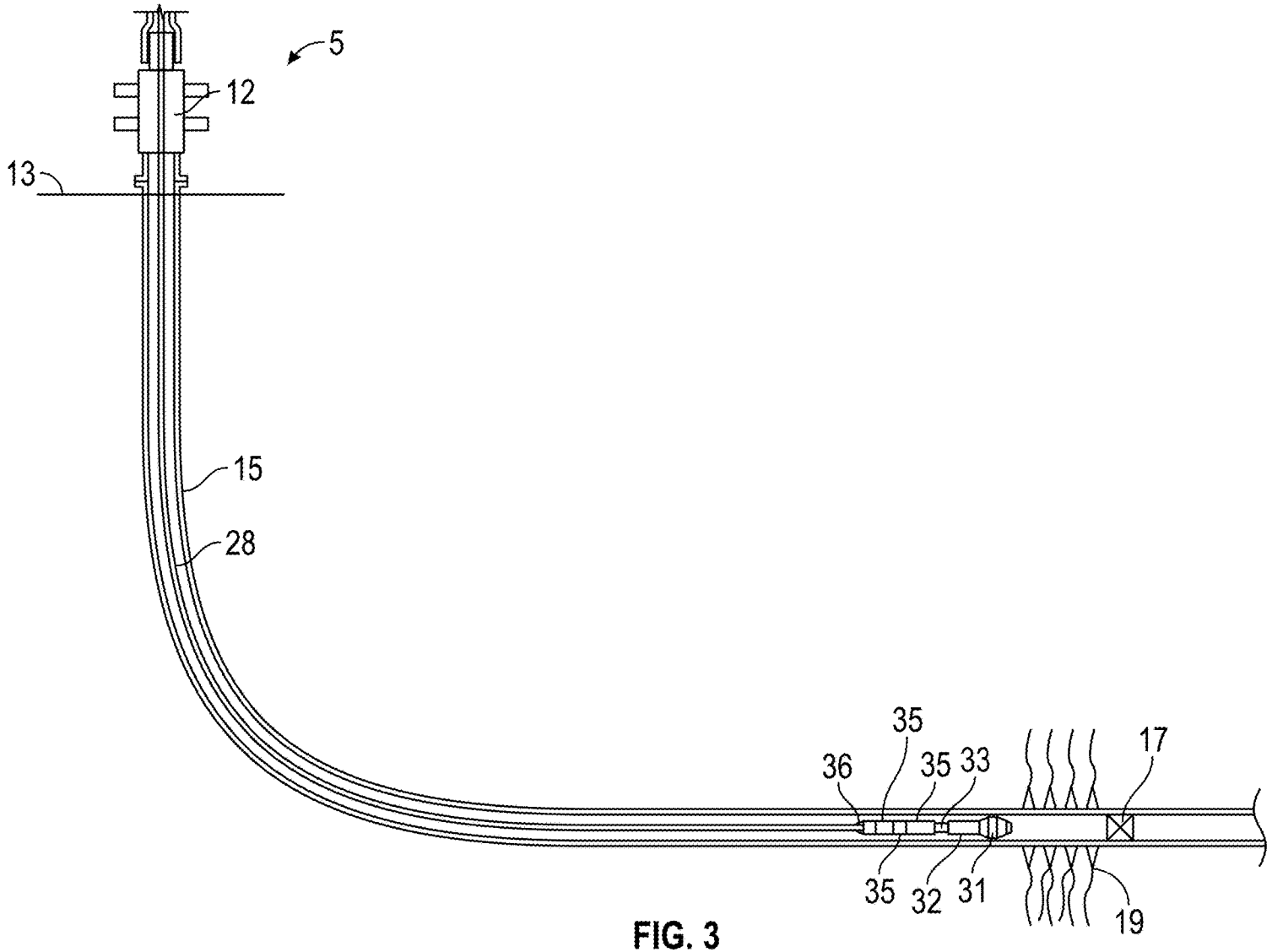
FIG. 3 (Prior Art)
FIG. 3 shows the plug that was carried into the well by the toolstring now set in the casing and separated from the toolstring.

Referring to FIG. 3, the toolstring 30 is shown located at the predetermined depth. Once at the predetermined depth, the plug 31 of toolstring 30 is set so that later, when fluid pressure is applied by a fracking system (not shown) from the surface 7, the fluid pressure is focused and limited to perforations created in the cased wellbore 10 above the set plug 31. The isolation provided by the set plug 31 prevents the fluid pressure from the surface-based fracking system to pass easily into other perforations located downhole from the plug 31 that are already opened from a prior fracking cycle. In FIG. 3, the plug 31 is shown as both set and disconnected from the remainder of the toolstring 30 which is located uphole from the set plug 31. The plug 31 is set and firmly anchored to the casing string 15 to seal the cased wellbore 10. Particularly, in this example, plug 31 seals a downhole production zone extending downhole from plug 31 to a previously set plug 17 (deployed and set using a previous toolstring). It may be understood that perforations 19 associated with the downhole production zone have previously been fracked and enlarged prior to the deployment of toolstring 30 into cased wellbore 10. As such, it may be understood that additional fracked production zones (not shown in FIG. 3) are formed downhole from the plug 17.

Figure 4:
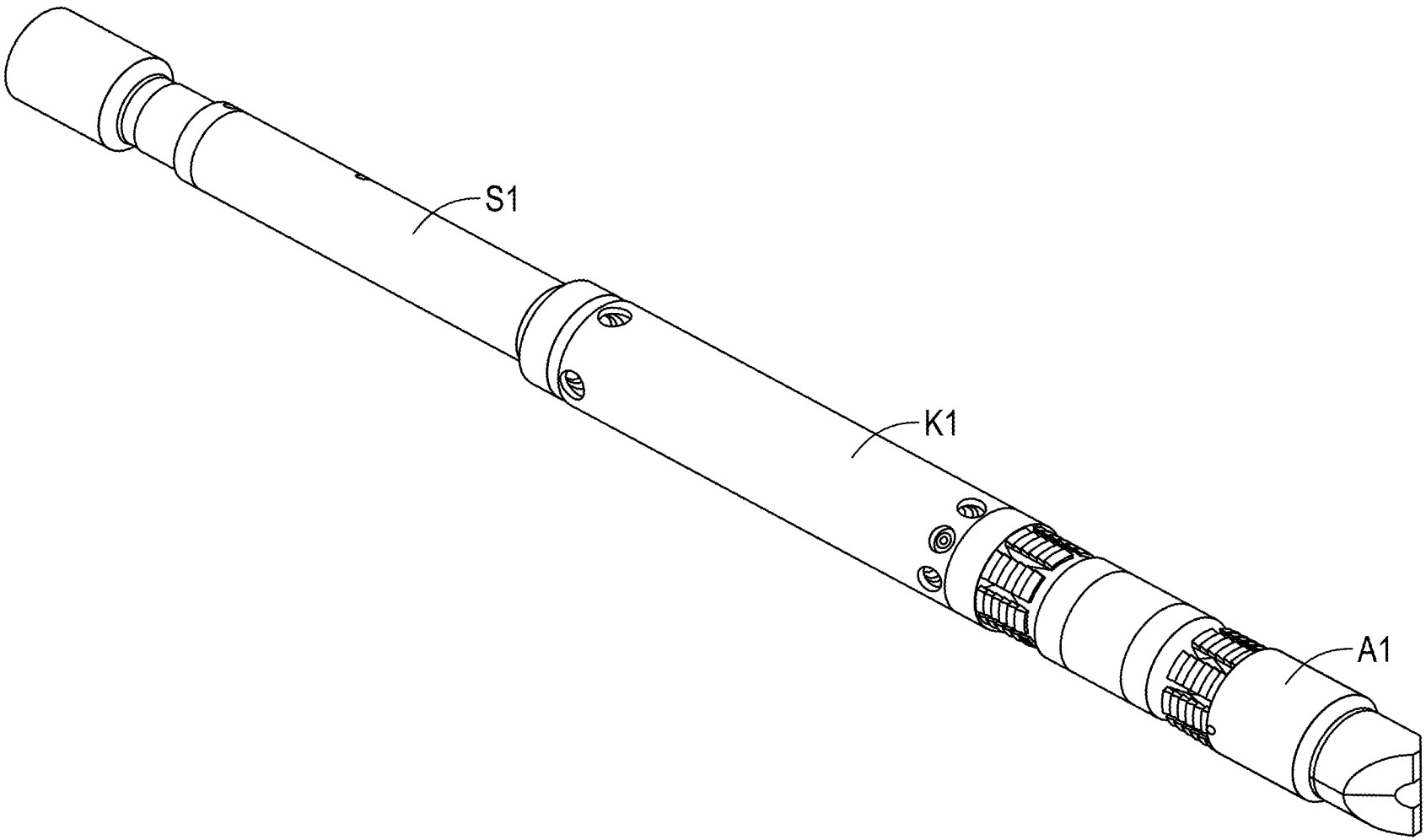
FIG. 4 (Prior Art)
FIG. 4 shows a perspective view of a first prior art plug setting arrangement from U.S. Pat. No. 9,810,035 comprising a setting tool, an adapter kit and a plug.
Figure 5:
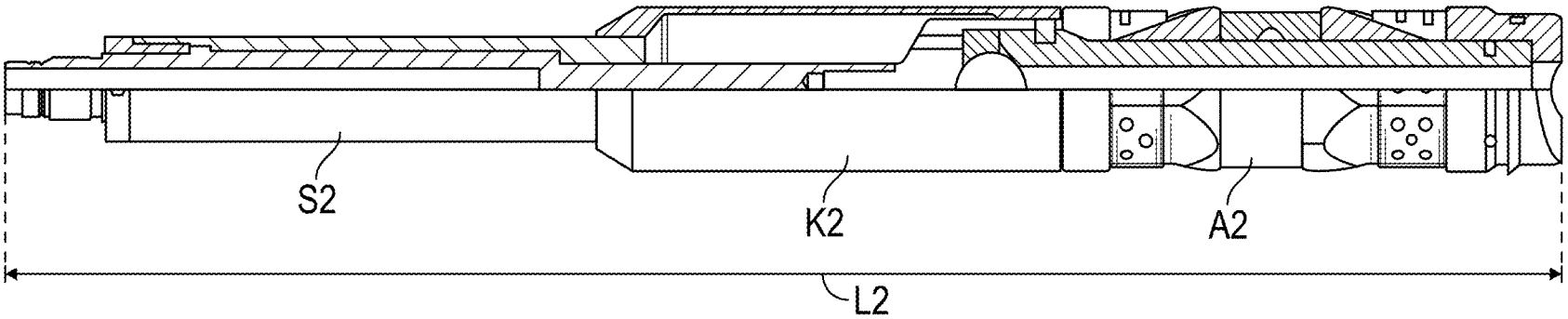
FIG. 5 (Prior Art)
FIG. 5 shows an elevation view partly in cross-section of a second prior art plug setting arrangement from U.S. Pat. No. 10,844,678 comprising a setting tool, an adapter kit and a plug.

Referring now to FIGS. 4 and 5 and as the present disclosure relates to setting plugs, two conventional plugging assemblies are shown. FIG. 4 shows a conventional plug A1 disclosed in U.S. Pat. No. 9,810,035 while FIG. 5 illustrates a conventional plug A2 disclosed in U.S. Pat. No. 10,844,678. Plugs A1 and A2 are attached to conventional adaptor kits K1 and K2, respectively. Additionally, adapter kits K1 and K2 are attached to conventional setting tools S1 and S2, respectively. The setting tools S1 and S2 may be exactly the same as there are a few standard designs. It is the adaptor kits, such as the adaptor kits K1 and K2 that are specially configured for the specific plug size and design and are a necessary and well-known component for conventional plugging assemblies. Indeed, there are multiple manufacturers of plugs that offer a number of differently designed plugs with many sized for the various casing sizes of wellbores. So, each plug requires its specific adaptor kit while most setting tools are designed for a small diameter well and used for all well diameters. And it is not uncommon for an adapter kit to be selected to adapt a setting tool made by a first manufacturer with a plug made by a second manufacturer. Fortunately, adaptor kits are typically the least complicated and least expensive of the three components of a plugging system so that those who supply adaptor kits may stock a significant variety to cover many of the various combinations of setting tools and plugs.

Figure 6:
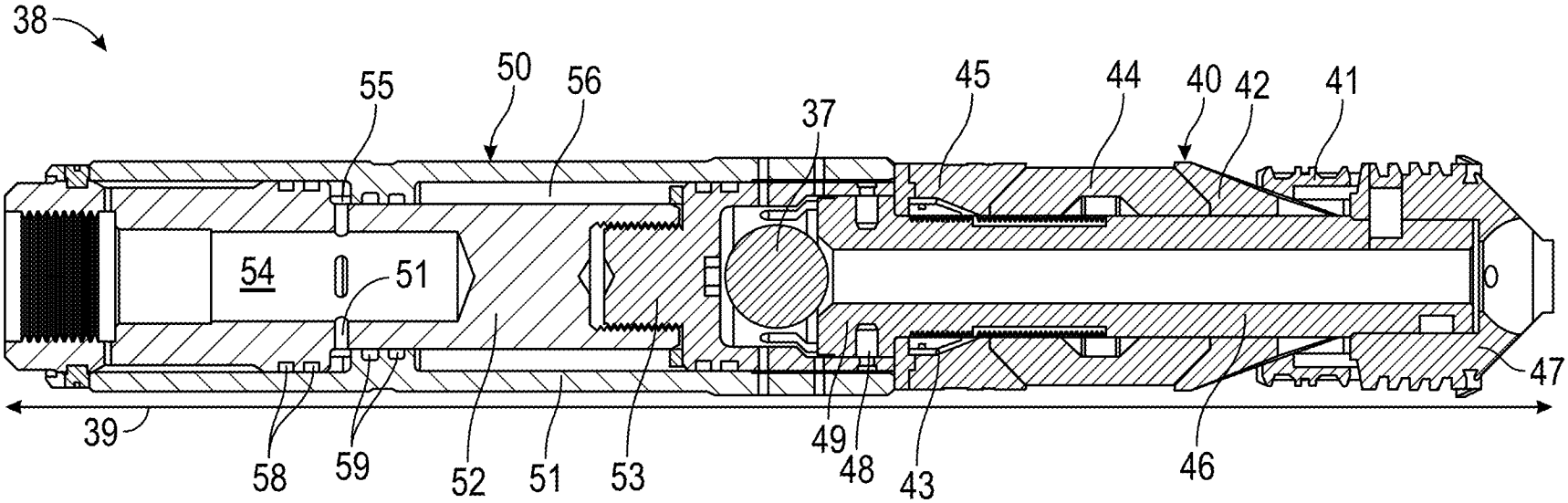
FIG. 6 shows an elevation cross sectional view of a first embodiment of a plugging assembly including a compact setting tool directly attached to a plug with the plug in a run-in configuration.

Referring now to FIG. 6 a first embodiment of a plugging assembly 38 of the present disclosure is shown for hydraulically separating a wellbore into separate uphole and downhole zones and which specifically does not include an adaptor kit or more particularly eliminates the adapter kit and saves the space on the toolstring normally occupied by an adapter kit. Particularly, in this exemplary embodiment, plugging assembly 38 includes a plug 40 and a setting tool 50, where the plug 40 is attached directly to the setting tool 50 such that no intervening component, such as an adapter kit, is interposed between the plug 40 and setting tool 50. It may be initially observed that the inventive plugging assembly 38 shown in FIG. 6 has a maximum length 39 that is substantially less than a maximum length L2 of the conventional plugging assembly shown in FIG. 5. This reduced length of plugging assembly 38 provides a significant advantage over conventional arrangements when considering the limits placed on the overall length of the toolstring as described above. Reconsider the needs for inserting toolstring 30 (shown in FIG. 1) into a well pressure containment system (e.g., valve tree 12 shown in FIG. 1) that requires a relatively long wireline lubricator 20 and a tall (and expensive) crane 11 to lift both the wireline lubricator 20 and toolstring 30 in the air to thereby pre-position the toolstring 30 inside the wireline lubricator 20.

In this exemplary embodiment, plug 40 of plugging assembly 38 generally includes a mandrel 46 extending the length of the plug 40 from a proximal or uphole end of the plug 40 to a distal or downhole end of the plug 40. In this exemplary embodiment, mandrel 46 occupies a central core of the plug 40 and thus may also be referred to herein as core 46. Plug 40 additionally includes a bull-nose 47 attached at the distal end of the mandrel 46 of the plug 40 while the proximal end 49 of the mandrel 46 (also referred to herein as the "stem" end of mandrel 46) of the plug 40 is received inside a shear cap 53 of the setting tool 50. Plugging assembly 38 additionally includes an obturating member or ball 37 which may seat against the stem of mandrel 46 once plug 40 has shifted to the set configuration to thereby seal an open passageway of the mandrel 46.

Figure 9:
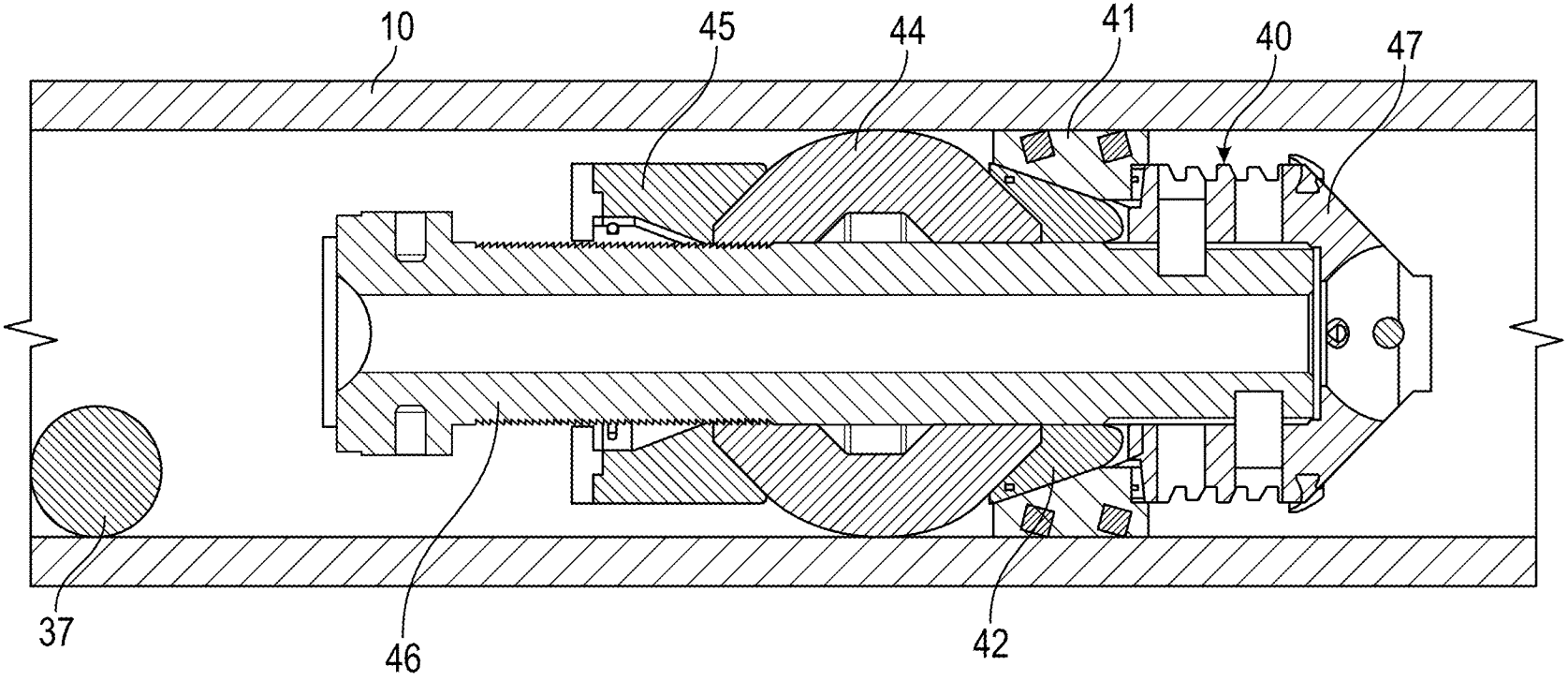
FIG. 9 shows an elevation cross-sectional view of the plug of FIG. 6 where the plug is in a set configuration.

Referring briefly to FIG. 9, when the setting tool 50 sets the plug 40, the bull-nose 47 of plug 40 is pulled uphole (leftwards as shown in FIG. 6 but uphole relative to the cased wellbore 10) while an uphole compression ring or fitting 45 of plug 40 is pressed by the setting tool 50 downhole along the outside of the mandrel 46 forcing an anchoring system or slips 41 of the plug 40, which surround a radially outer periphery of the mandrel 46, along inclined ramps 42 of the plug 40 to move the slips 41 radially outwards away from the mandrel 46 such that slips 41 bite into, and anchor against, the of cased wellbore 10. Slips 41 anchor the plug 40 to the casing string 15 in a fixed position. As shown particularly in FIG. 9, the slips 41 are radially expanded against the casing string 15, an elastomeric sealing element 44 of plug 40 flexes or bulges radially outwards to seal against an inside wall or inner surface of the casing string 15. In this exemplary embodiment, the mandrel 46 and a lock element or ring 43 of the plug 40 which surrounds the mandrel 46 have complementary sets of ratchet teeth on the periphery of the mandrel 46 and on the inside of the lock ring 43 so that, as the mandrel 46 is pulled relative to the lock ring 43 there is movement, but the mandrel 46 is not permitted to slide backwards towards its run-in position due to the complementary ratchet shaped teeth. This arrangement helps set the plug 40 more securely in the casing string 15.

Figure 7:
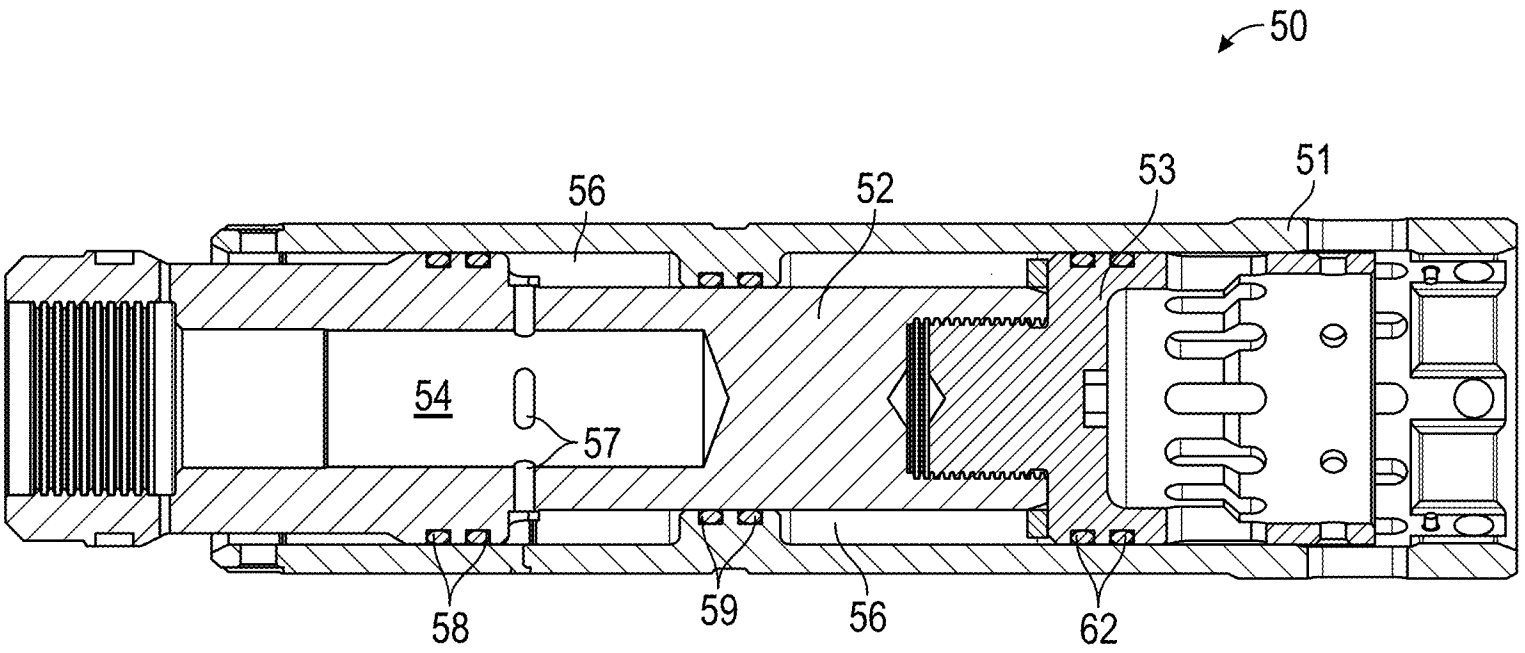
FIG. 7 shows an elevation cross sectional view of the setting tool of FIG. 6 without the plug attached, but showing the compact setting tool in a mid-stroke position with a mandrel of the setting tool roughly half-way between an unstroked position and a stroked position.
Figure 8:
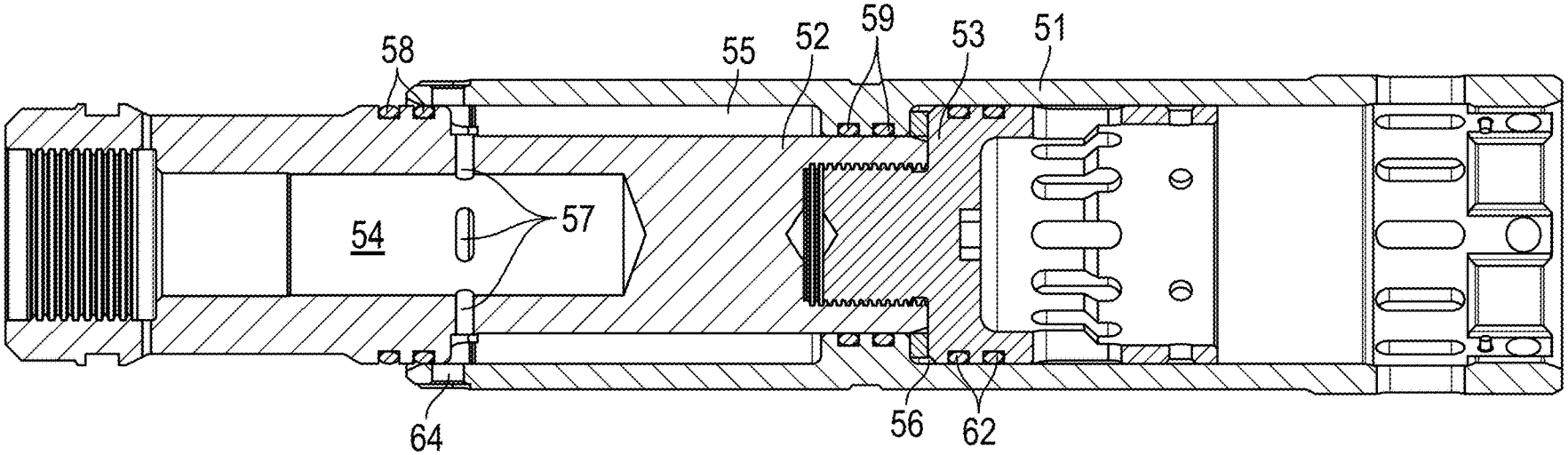
FIG. 8 shows an elevation cross-sectional view of the setting tool of FIG. 6 with the mandrel of the setting tool in stroked position.

Returning back to FIG. 6, in this exemplary embodiment, setting tool 50 generally includes housing 51 and a setting tool mandrel 52 that is arranged to move axially within and relative to the housing 51. A distal end of the setting tool mandrel 52 that is oriented toward the plug 40 (located downhole from the setting tool 50) includes a shear cap 53 in an exemplary arrangement but could, in other embodiment, have whatever shape and function to fit the plug being used with the setting tool 50. The shear cap 53 may also be fully integrated with setting tool mandrel 52 such that mandrel 52 and shear cap 53 form an integral, monolithically formed member, or may be formed of separate members that are attached together as an assembly as shown in FIGS. 6-8. The shear cap 53 is also connected to the uphole end of the plug mandrel 46 by at least one shear member 48.

In this exemplary embodiment, setting tool mandrel 52 further includes a combustion chamber 54 in which is placed an energetic charge, not shown. The energetic charge may comprise a combustible material configured to generate highly pressurized combustion gasses upon initiation. The setting tool 50 and plug 40 of plugging assembly 38 are each shown in FIG. 6 in a run-in configuration, respectively, where the uphole end (left end in FIG. 6) of the setting tool mandrel 52 is at a proximal end of the housing. The uphole end should be understood to be opposite the downhole end where the downhole end is furthest from the surface 7 and deepest in the cased wellbore 10 when installed in the wellbore 10 while the uphole end is closer to the surface 7 when plugging assembly 38 is installed in the wellbore 10. In the run-in configuration, the combustible element is positioned within the combustion chamber 54 of the setting tool mandrel 52.

In this exemplary embodiment, setting tool mandrel 52 includes one or more radially oriented channels or passages 57 which are open for the flow of fluids, and more particularly gases, from the combustion chamber 54 into an annular expansion chamber 55 located radially outside of the mandrel 52 and inside the housing 51. The expansion chamber 55 is defined at each end by a pair of annular seals or O-rings 58 attached to the mandrel to seal against the inside of the housing 51 toward the proximal end of the expansion chamber 55. A second set of annular seals or O-rings 59 is similarly attached to the housing to seal against the periphery of the setting tool mandrel 52 at the distal end of the expansion chamber 55. O-rings 59 separate the expansion chamber 55 from an annular air chamber 56 located radially outside of the mandrel 52 and inside of the housing 51.

Referring now to FIGS. 7 and 8, the stroking of the setting tool 50 from the run-in configuration to a stroked configuration will be more fully explained. When the combustible element that has been described as positioned in combustion chamber 54 is triggered by a signal from the surface 7, the triggered combustible element quickly creates hot and high-pressure gases which travel through the radial channels 57 of setting tool mandrel 52 to rapidly pressurize the expansion chamber 55 surrounding the mandrel 52. As the expansion chamber 55 pressurizes, the expansion chamber 55 grows or extends axially such that the housing 51 moves relative to the setting tool mandrel 52 which imposes both a tensile force on the plug mandrel 46 through the connection of the shear cap 53 with the uphole end of the plug mandrel 46, and a compressive force of the setting tool housing 51 pressing axially against the uphole compression fitting 45 of the plug 40. The opposed axial movements of the setting tool mandrel 52 and the housing 51 in-turn creates compressive forces on the functional elements of the plug 40 as previously described to set the plug inside the casing string 15.

As best seen in FIG. 7, the shear cap 53 is pulled further uphole into the housing 51 toward the uphole end thereof. Setting tool 50 is shown in FIG. 7 in a mid-stroke configuration and it would be expected that the uphole end of the plug mandrel 46 would be pulled further into the setting tool housing 51. It should also be pointed out that the uphole end of the plug mandrel 46 was inside the shear cap 53 in the run-in configuration and both were inside of the setting tool housing 51 before the stroking of the setting tool 50 began. Eventually, and potentially before the setting tool 50 reaches the stroked configuration, the resistance of the functional elements on the outside of the plug mandrel 46 such as, for example, the slips 41, the ramps 42 and the elastomeric sealing element 44 against further axial compression will exceed the shear strength of the shear member 48 and the shear member 48 will sever from an unsevered configuration to a severed configuration allowing the stem end of the plug mandrel 46 to break away from the shear cap 53. In response to the shearing of the shear member 48, the setting tool 50 along with the rest of the toolstring 30 moves axially in the casing string 15 away from the plug 40 as the stroking of the setting tool has some remainder of its stroke to fully travel.

Setting tool 50 is shown in FIG. 8 in the stroked configuration where the radial channels 57 come into fluid communication of the vent holes 64 such that the remaining high-pressure gases are vented out of the pressure expansion chamber 55. It should be noted that there is an accommodating annular space 56 located on the other side of the second set of O-rings 59 from the pressure expansion chamber 55 that reduces in size and specifically axially length as the pressure annular space grows in length. The accommodating annular space 56 is defined at its distal end by a third set of O-rings 62 of the setting tool 50. In this exemplary embodiment, accommodating annular space 56 is formed upon the assembly of the setting tool 50 at its manufacturing facility and is filled with compressible air at atmospheric pressure existing at the time of assembly (e.g., less than 15 pounds per square inch absolute (PSIA)). This is helpful to the stroking of the setting tool 50 in that the stroking of the setting tool is not pulling the stem end of the mandrel 46 of the plug 40 with an incompressible fluid limiting the rate of which the stroking of the setting tool may occur. With the arrangement as shown, the pressure in the pressure annular space may exceed 10,000 psi and may approach 50,000 psi to drive the mandrel 52 upward relative to the housing at the ordinary air pressure in the accommodating annular space which thereby hardly resists the movement and that annular space closes down to a very minimal axial dimension at the end of the stroke.

Figure 10:
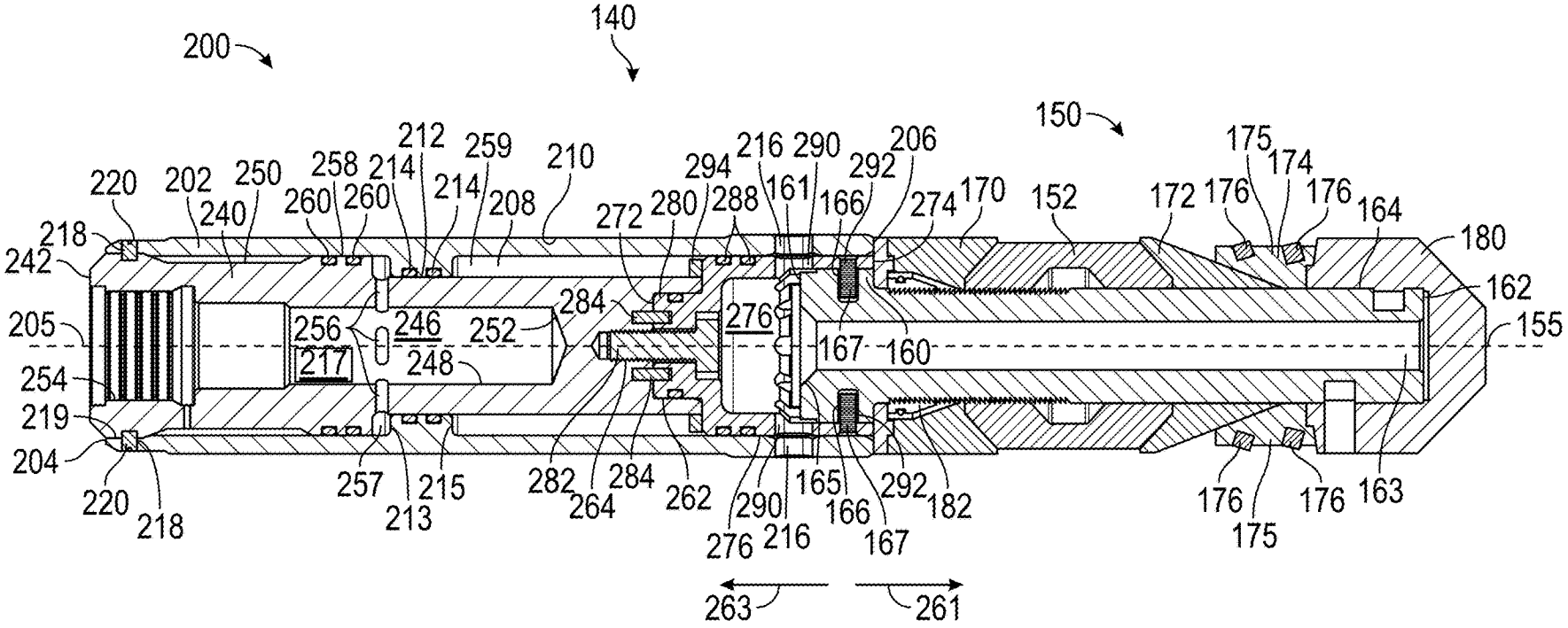
FIG. 10 shows an elevation cross-sectional view of another embodiment of a plugging assembly including a setting tool and a plug, where the plug is shown in a run-in configuration.

Referring now to FIG. 10, another embodiment of a plugging assembly 140 is shown generally including a plug 150 and a setting tool 200. In this exemplary embodiment, plug 150 has a central or longitudinal axis 155 and generally includes sealing element 152, a central core 160, a first or uphole compression ring or fitting 170, a second or downhole compression ring or fitting 172, an anchoring system or slip assembly 174, a compression sleeve 180, and a locking assembly 182. Core 160 extends centrally through plug 150 and comprises a proximal or uphole end 161, a distal or downhole end 162 opposite uphole end 161, a central passage or open passageway 163, and generally cylindrical outer surface 164 extending between ends 161, 162. In this exemplary embodiment, the open passageway 163 of core 160 includes an annular seat 165 for receiving an obturating member or ball (not shown in FIG. 10) configured to restrict fluid communication through open passageway 163 in at least one axial flow direction. Additionally, in this exemplary embodiment, one or more circumferentially spaced receptacles 166 are formed in the outer surface 164 of core 160, each of which is configured to receive a frangible member or shear pin 167 configured to frangibly couple the core 160 to setting tool 200.

Compression fittings 170 and 172 may each comprise a single, unitary or monolithically formed member, or a plurality of members coupled together. In this exemplary embodiment, uphole compression fitting 170 is shown as comprising several annular components coupled together. Additionally, compression fittings 170 and 172 are each positioned adjacent sealing element 152 while slip assembly 174 is positioned between the downhole compression fitting 172 and compression sleeve 180. In this exemplary embodiment, slip assembly 174 includes a plurality of slip members 175 each including a plurality of engagement members or teeth 176. The teeth 176 of slip assembly 174 are configured to engage or bite into the inner surface of a casing string (e.g., casing string 15 shown in FIG. 1) upon the actuation of plug 150 by setting tool 200 to couple or affix the plug 150 to the casing string whereby relative movement between plug 150 and casing string is restricted.

In this exemplary embodiment, compression sleeve 180 is located at, and defines, a downhole end of the plug 150 and may also be referred to herein as a nose or nose cone 180. However, it may be understood that in other embodiments compression sleeve 180 may not be located at the downhole end of plug 150. Compression sleeve 180 of plug 150 is positioned at a terminal end of plug 150 and is coupled to the downhole end 162 of core 160. Locking assembly 182 of plug 150 is configured to lock the plug 150 in a set configuration following stroking of the setting tool 200 from a run-in configuration of the tool 200 to a stroked configuration of the tool 200. Locking assembly 182 may engage uphole compression fitting 170 to restrict relative axial movement between locking assembly 182 and the uphole compression fitting 170 as well as the sealing element 152. Locking assembly 182 may also comprise engagement members configured to matingly engage engagement members with core 160 to restrict relative movement between core 160 and locking assembly 182 following actuation of plug 150, thereby locking the plug 150 in the set configuration.

Figure 11:
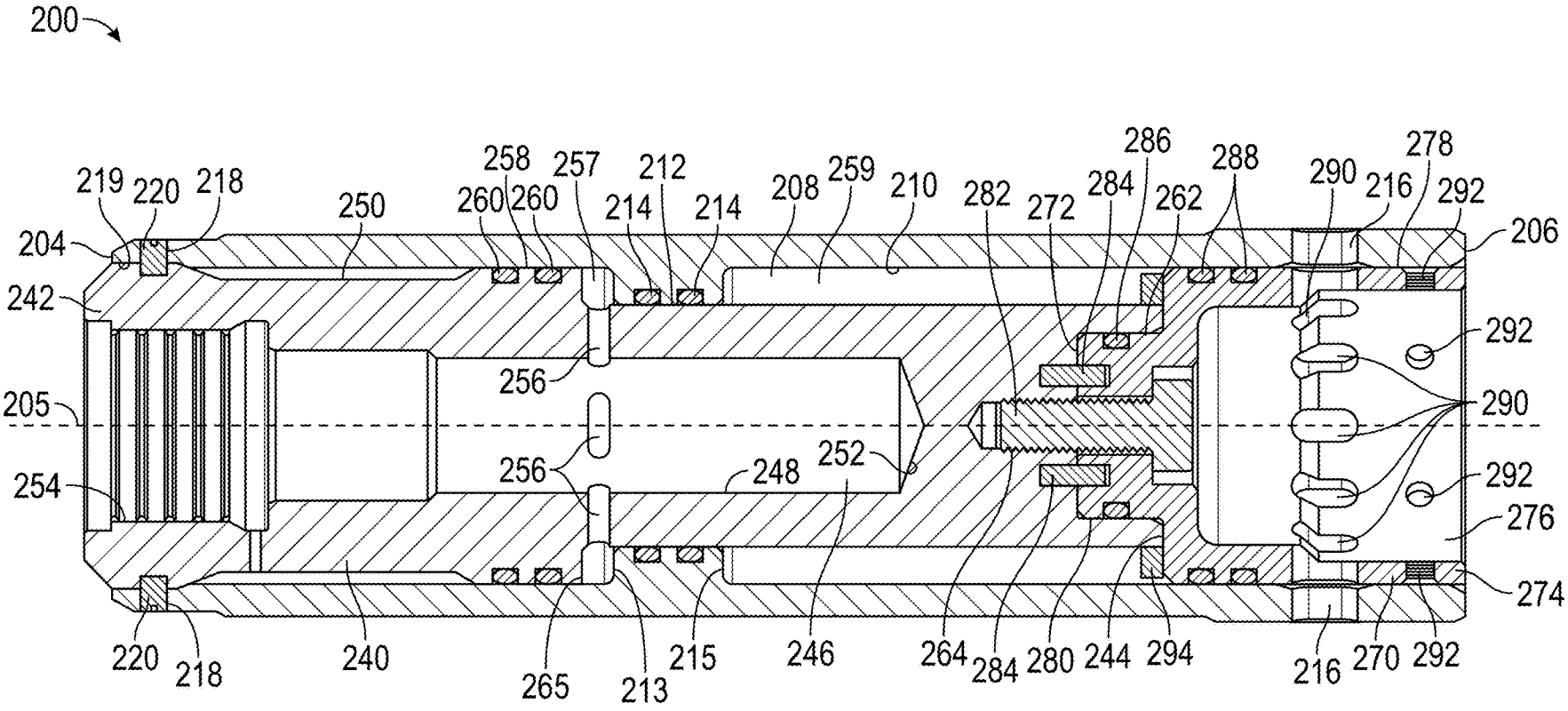
FIG. 11 shows an elevation cross-sectional view of the setting tool of FIG. 10 with a mandrel of the setting tool in an unstroked position.
Figure 12:
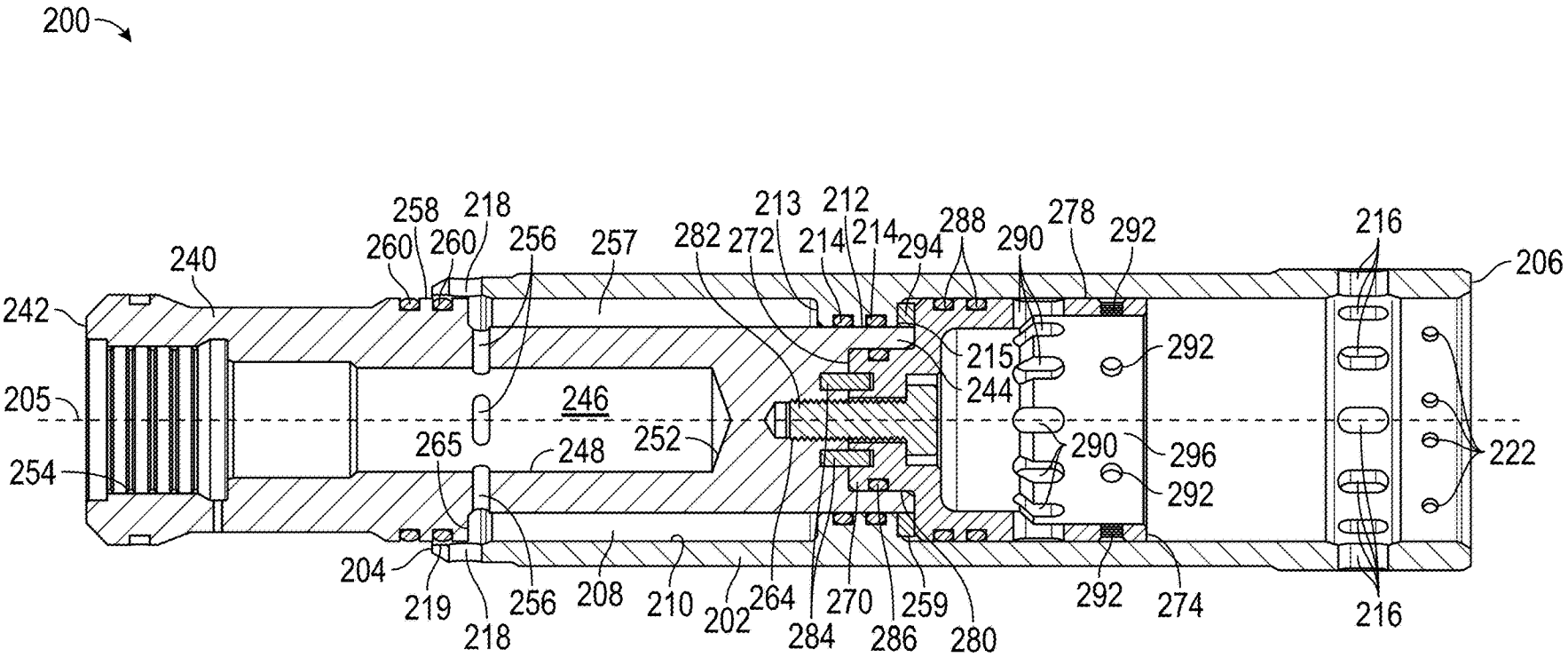
FIG. 12 shows a cross-sectional elevation view of the setting tool of FIG. 6 with the mandrel of the setting tool in a stroked position.

Referring to FIGS. 10-12, additional views of the setting tool 200 are shown in FIGS. 11 and 12. As described above, setting tool 200 is configured to stroke from the run-in configuration to the stroked configuration to thereby actuate plug 150 from a run-in configuration shown to a set configuration whereby the sealing element 152 sealingly engages the inner surface of casing string. While setting tool 200 is described herein as being configured to actuate plug 150, setting tool 200 may be used to actuate plugs that differ in configuration from plug 150.

In this exemplary embodiment, setting tool 200 has a central or longitudinal axis 205 and generally comprises an outer or piston housing 202, a mandrel 240 slidably received in the housing 202, and an adapter or shear cap 270 coupled to the mandrel 240. Housing 202 includes an uphole end 204, a downhole end 206 opposite uphole end 204, a central passage or open passageway 208 defined by a generally cylindrical inner surface 210 extending between ends 204, 206. No threaded or other connections are formed along the housing 202 between ends 204, 206 thereof. Additionally, in this exemplary embodiment, housing 202 comprises an integral, monolithically formed member. The lack of threaded or other connections along housing 202 minimizes the time required for assembling setting tool 200 by obviating the need to, for example, rotatably couple together a plurality of housing sections to form a single housing assembly, or to rotatably couple the housing with an intermediate tubular member such as a setting sleeve of a wireline adapter kit. The removal of the setting sleeve of the wireline adapter kit also minimizes the overall length of the assembled setting tool 200 and plug 150, making the assembly easier to transport to the wellsite as well as easier to deploy downhole within wellbore 4.

In this exemplary embodiment, the inner surface 210 of housing 202 comprises a reduced diameter region or annular protrusion 212 on which a pair of annular seal assemblies 214 are positioned. Seal assemblies 214 may each comprise an elastomeric seal or O-ring positioned in an annular groove formed in the protrusion 212. Additionally, protrusion 212 forms an annular first shoulder 213 and an annular second shoulder 215 on the inner surface 210 of housing 202.

Further, in this exemplary embodiment, housing includes a plurality of radial ports 216 located proximal the downhole end 206 thereof and a plurality of radial receptacles 218 located at the uphole end 204. Radial ports 216 may be circumferentially spaced from each other and are configured to provide for fluid flow between the open passageway 208 of housing 202 and an environment surrounding setting tool 200 (e.g., wellbore 4 when setting tool 200 is positioned therein). Each radial receptacle 218 may receive a frangible member or shear pin 220 which frangibly connects the mandrel 240 with the housing 202 such that relative axial movement therebetween is restricted. As will be discussed further herein, shear pins 220 are configured to retain housing 202 of setting tool 200 in a first position shown in FIG. 11 until it is desired to actuate housing 202 into a second position shown in FIG. 12 which is axially spaced from the first position.

As shown particularly in FIG. 11, the housing 202 of setting tool 200 has a minimum inner diameter and a maximum outer diameter each located between the opposing ends 204, 206 of housing 202. In this exemplary embodiment, the maximum outer diameter of housing 202 is less than 5% larger than the minimum outer diameter of housing 202. In certain embodiments, the maximum outer diameter is less than half an inch larger than the minimum outer diameter. In some embodiments, the maximum outer diameter is less than three eights of an inch larger than the minimum outer diameter. In certain embodiments, the maximum outer diameter is substantially equal to the minimum outer diameter. The relative consistency of the outer diameter of housing 202 may allow setting tool 200 to be utilized in a broader array of applications, including in applications in which the casing string has a relatively small inner diameter.

Mandrel 240 of setting tool 200 is slidably received in the open passageway 208 of housing 202 and generally includes an uphole end 242, a downhole end 244 opposite uphole end 242, and a central opening or passage 246 defined by a generally cylindrical inner surface 248, a generally cylindrical outer surface 250 extending between ends 242, 244. No threaded or other connections are formed along the mandrel 240 between ends 242, 244 thereof. Additionally, in this exemplary embodiment, mandrel 240 comprises an integral, monolithically formed member. The lack of threaded or other connections along mandrel 240 minimizes the amount of time required for assembling setting tool 200 by obviating the need to, for example, rotatably couple together multiple mandrel sections to form a complete mandrel assembly.

Central opening 246 of mandrel 240 extends partially through mandrel 240 from uphole end 242, terminating at a terminal end 252 within mandrel 240. Central opening 246 may receive an energetic charge 217 (shown in FIG. 10) and thus may also be referred to herein as combustion chamber 246. The energetic charge 217 may comprise a combustible material configured to generate highly pressurized combustion gasses upon initiation. In this exemplary embodiment, the inner surface 248 of central opening 246 comprises a releasable connector, such as a threaded connector, configured to matingly and releasably couple with a corresponding connector of a firing head of a toolstring (e.g., toolstring 30 shown in FIG. 1) comprising the plugging assembly 140. Additionally, mandrel 240 comprises a plurality of circumferentially spaced radial ports 256 which provide for fluid communication between central opening 246 of mandrel 240 and the open passageway 208 of housing 202.

In this exemplary embodiment, the outer surface 250 of mandrel 240 comprises an annular expanded diameter region or protrusion 258 on which a pair of annular seal assemblies 260 are positioned. Seal assemblies 260 may each comprise an elastomeric seal or O-ring positioned in an annular groove formed in the protrusion 258. In this configuration, seal assemblies 214 of housing 202 sealingly engage the outer surface 250 of mandrel 240 while the seal assemblies 260 of mandrel 240 sealingly engage the inner surface 210 of housing 202, forming an annular expansion chamber 257.

Expansion chamber 257 extends radially between the outer surface 250 of mandrel 240 and the inner surface 210 of housing 202, and axially between the seal assemblies 214 of housing 202 and the seal assemblies 260 of mandrel 240. Fluid communication is provided between expansion chamber 257 and the central opening 246 of mandrel 240 via radial ports 256 of mandrel 240. As will be discussed further herein, central opening 246 of mandrel 240 may receive a combustible power cartridge (not shown in FIGS. 10-12) configured to combust and thereby generate combustion gasses in response to being ignited by a firing head of the toolstring. The combustion gasses generated by the power cartridge upon ignition may be communicated to expansion chamber 257 via radial ports 256.

The shear cap 270 of setting tool 200 is generally configured to couple the mandrel 240 of setting tool 200 with the core 160 of plug 150. Shear cap 270 generally includes an uphole end 272 directly connected to mandrel 240, a downhole end 274 opposite uphole end 272, a central opening or passage 276 extending between ends 272, 274, and a generally cylindrical outer surface 278 extending between ends 272, 274. No threaded or other connections are formed along the shear cap 270 between ends 272, 274 thereof. Additionally, in this exemplary embodiment, shear cap 270 comprises an integral, monolithically formed member. The lack of threaded or other connections along shear cap 270 minimizes the amount of time required for assembling setting tool 200 by obviating the need to, for example, rotatably couple together multiple shear cap sections to form a complete shear cap assembly.

Directly connecting the shear cap 270 to the mandrel 240 such that no intermediate members are positioned between mandrel 240 and shear cap 270 may also minimize the overall length of setting tool 200 by eliminating the need to include additional tubular members between mandrel 240 and shear cap 270. Particularly, conventional setting tools may couple to a plug through a wireline adapter kit positioned therebetween and including a setting sleeve coupled to the housing of the conventional setting tool and a shear cap assembly coupled to the mandrel of the conventional setting tool. While the wireline adapter kit may allow some conventional setting tools to be adapted to varying plugs, the adapter kit increases the overall length of the conventional setting tool, adapter kit, and plug assembly, thereby increasing the costs of manufacturing, shipping, and deploying the assembly downhole. Conversely, shear cap 270 is integrated directly into setting tool 200, obviating the need to couple setting tool 200 with a wireline adapter kit.

In this exemplary embodiment, shear cap 270 comprises a reduced diameter region or annular hub 280 at the uphole end 272 thereof. Hub 280 of shear cap 270 is received in a cylindrical opening or socket 262 formed in the downhole end 244 of mandrel 240. A fastener 282 extends centrally through hub 280 and into a threaded receptacle 264 extending into mandrel 240 from a terminal end of socket 262. Threads formed on an outer surface of fastener 282 may threadably engage threads formed on an inner surface of threaded receptacle 264 to thereby releasably or threadably connect the uphole end 272 of shear cap 270 to the downhole end 244 of mandrel 240 whereby relative axial movement between shear cap 270 and mandrel 240 is restricted.

Additionally, one or more anti-rotation pins 284 radially offset from central axis 205 extend axially between hub 280 of shear cap 270 and mandrel 240 to prevent rotation between shear cap 270 and mandrel 240. Particularly, anti-rotation pins 284 allow shear cap 270 to be retained or locked in a predefined angular position relative to mandrel 240. An annular first seal assembly 286 is positioned on hub 282 and sealingly engages an inner surface of the socket 262 of mandrel 240. First seal assembly 286 may comprise an elastomeric seal or O-ring positioned in an annular groove formed in the hub 280.

The combination of fastener 282 and anti-rotation pins 284 allows for the angular orientation of shear cap 270 relative to mandrel 240 to be controlled as desired while also eliminating the need for a threaded connection directly between the shear cap 270 and mandrel 240 and set screws extending radially therebetween which may be relatively difficult to assemble. Particularly, fastener 282 and anti-rotation pins 284 allow for shear cap 270 to be assembled with mandrel 240 while mandrel 240 is received within housing 202 which may not be possible with a connection requiring the assembly of radially extending set screws. However, while in this exemplary embodiment coupling of shear cap 270 with mandrel 240 is achieved via fastener 282 and anti-rotation pins 284, in other embodiments, the mechanism for coupling shear cap 270 with mandrel 240 may vary. In still other embodiments, mandrel 240 and shear cap 270 may comprise a single integral, monolithically formed member and thus shear cap 270 may comprise a portion or section of the mandrel 240.

In this exemplary embodiment, shear cap 270 additionally includes an annular pair of second seal assemblies 288 positioned on the outer surface 278 thereof, a plurality of circumferentially spaced radial ports 290, and a plurality of circumferentially spaced receptacles 292. Second seal assemblies 288 sealingly engage the inner surface 210 of housing 202. Seal assemblies 288 may each comprise an elastomeric seal or O-ring positioned in an annular groove formed in the outer surface 278 of shear cap 270. In this configuration, seal assemblies 214 of housing 202 sealingly engage the outer surface 250 of mandrel 240 while the seal assemblies 288 of shear cap 270 sealingly engage the inner surface 210 of housing 202, forming an annular atmospheric or contraction chamber 259. Contraction chamber 259 extends radially between the outer surface 250 of mandrel 240 as well as a portion of the outer surface 278 of shear cap 270, and the inner surface 210 of housing 202. Contraction chamber 259 extends axially between the seal assemblies 214 of housing 202 and the seal assemblies 288 of shear cap 270. In this exemplary embodiment, contraction chamber 259 is filled with a compressible fluid (e.g., air) at atmospheric pressure prior to lowering a toolstring comprising the plugging assembly 140 downhole.

In this exemplary embodiment, an annular shock absorber 294 is positioned within contraction chamber 259; however, in other embodiments, setting tool 200 may not include shock absorber 294. As will be discussed further herein, the volume of contraction chamber 259 is reduced as housing 202 travels from the first position to the second position until the shock absorber 294 contacts the second shoulder 215 of housing 202, thereby arresting the axial travel (in the direction of plug 150) of housing 202 relative to mandrel 240. Shock absorber may minimize the shock and/or stress transmitted to housing 202, mandrel 240, and shear chap 270 following impact between shock absorber 294 and the second shoulder 215 of housing 202.

Radial ports 290 of shear cap 270 are radially aligned with the radial ports 216 of housing 202 whereby fluid may be readily communicated between the central opening 276 of shear cap 270 and the environment surrounding setting tool 200 (e.g., cased wellbore 10 when toolstring 30 is positioned therein). This fluid communication may allow for fluid to flow into central opening 276 of shear cap 270 as the setting tool 200 is removed from the wellbore (e.g., cased wellbore 10) to thereby prevent a vacuum from forming in central opening 276 which may otherwise increase the difficulty in the retrieving toolstring from the wellbore.

Angular alignment between radial ports 290 of shear cap 270 and radial ports 216 of housing 202 may be maintained with housing 202 in the first position via the angular locking between shear cap 270 and mandrel 240 provided by anti-rotation pins 284 as well as the rotational locking provided between mandrel 240 and housing 202 by shear pins 220. In other words, anti-rotation pins 284 and shear pins 220 allow for the shear cap 270 to be locked into a desired angular orientation relative to the housing 202 when housing 202 is in the first position.

Receptacles 292 of shear cap 270 are configured to receive the shear pins 167 shown in FIG. 10 to frangibly couple the core 160 of plug 150 with the shear cap 270 of setting tool 200. Particularly, in this exemplary embodiment, the uphole end 161 of core 160 is at least partially received in the central opening 276 of shear cap 270 with receptacles 292 of shear cap 270 axially and circumferentially aligned with the receptacles 166 formed in core 160 whereby each shear pin 167 may be at least partially received in both one of the receptacles 292 and one of the receptacles 166. In some embodiments, each shear pin 167 may be threaded to both one of the receptacles 292 and one of the receptacles 166.

Shear pins 167 may be inserted into the receptacles 292 of shear cap 270 while shear cap 270 is received in the open passageway 208 of housing 202 following the coupling of shear cap 270 with mandrel 240 as described above. Particularly, housing 202 includes a plurality of circumferentially spaced apertures 222 positioned at downhole end 206 and which are circumferentially offset from radial ports 216. Apertures 222 of housing 202 may be circumferentially aligned with receptacles 292 of shear cap 270 during assembly, allowing shear pins 167 to be inserted and threaded into receptacles 292 via the apertures 222 of housing 202 aligned therewith. Following the insertion of shear pins 167 into receptacles 292 of shear cap 270 and the receptacles 166 of core 160, housing 202 may be rotated relative mandrel 240 to circumferentially align radial receptacles 218 of housing 202 with corresponding receptacles formed in mandrel 240 at uphole end 242. Shear pins 220 may be inserted or threaded into and through radial receptacles 218 of housing 202 and the corresponding receptacles of mandrel 240 to provide a frangible connection which rotationally and axially locks housing 202 with mandrel 240.

Referring still to FIGS. 10-12, a toolstring comprising the plugging assembly 140 may be deployed into a wellbore (e.g. the cased wellbore 10 shown in FIG. 1) to perforate a casing string (e.g., casing string 15 shown in FIG. 1) at a desired location. Particularly, following the assembly of the toolstring, the string may be lowered through the wellbore via a surface assembly until the toolstring is disposed in a desired position in the wellbore. Plug 150 is disposed in the run-in configuration and mandrel 240 of setting tool 200 is located in the first position as the toolstring is lowered through the wellbore towards the desired position. At this desired position, a signal may be transmitted from the surface assembly through wireline 28 and to a component of a firing head of the toolstring where the firing head initiates the combustion of energetic charge 217 (shown in FIG. 10) positioned in the central opening 246 of the mandrel 240 of setting tool 200.

Combustion of the energetic charge 217 of setting tool 200 generates pressurized combustion gasses which flow into the expansion chamber 257 of setting tool 200. The pressurized combustion gasses act against the first shoulder 213 of the protrusion 212 of housing 202, thereby applying a net pressure force against housing 202 in a first or downhole axial direction (indicated by arrow 261 in FIG. 10) directed towards the plug 150. A net pressure force is also applied to mandrel 240 by the combustion gasses pressing against a shoulder 265 formed by the protrusion 258 of mandrel 240. However, the net pressure force applied to mandrel 240 by the combustion gasses is in a second or uphole direction (indicated by arrow 263 in FIG. 10) which is opposite the first direction 261 such that mandrel 240 travels uphole from a first or unstroked position within the open passageway 208 of housing 202 to a second or stroked position that is axially spaced from the unstroked position.

The net pressure force generated by the combustion gasses and applied to housing 202 also applies a shear force to the shear pins 220 until the increasing net pressure force overcomes the shear strength of shear pins 220 and thereby shears the shear pins 220. In other words, shear pins 220 each have an unsevered configuration connecting the plug 150 with the setting tool 200 and a severed configuration in which the plug 150 is disconnected from the setting tool 200. With the shearing of shear pins 220, housing 202 is forced in the first direction 261 by the net pressure force applied by the combustion gasses towards plug 150. The unstroked position of mandrel 240 and unsevered configuration of shear pins 220 correspond to a run-in configuration of the plug 150 in which plug 150 is connected to the setting tool 200 while the stroked position of mandrel 240 and severed configuration of shear pins 220 correspond to a set configuration of the plug 150 where the sealing element 152 and the slip assembly 174 of the plug 150 are deployed toward an inner surface of the casing string 15 and the shear pins 220 have severed to separate the setting tool 200 from the plug 150.

Further, expansion chamber 257 is configured to assume different volumes depending on the configuration of the plug 150 and the position of mandrel 240. Particularly, the unstroked position of mandrel 240 leads to the expansion chamber 257 having a first volume corresponding to the run-in configuration of the plug, and the stroked position of the mandrel 240 leads to the expansion chamber 257 having a second volume, which is larger than the first volume, corresponding to the set configuration of the plug. The expansion chamber 257 has a first longitudinal length corresponding to the first volume, and a second longitudinal length, which is greater than the first longitudinal length, corresponding to the second volume.

With the downhole end 206 of housing 202 being adjacent the uphole compression fitting 170 of plug 150, the force applied to housing 202 in the first direction 261 by the combustion gasses is transferred to the uphole compression fitting 170. With uphole compression fitting 170 being forced in the first direction 261 by the combustion gasses within setting tool 200, compression sleeve 180 of plug 150 is coupled to mandrel 240 of setting tool 200 and thus are restricted from traveling in the first direction 261 (the combustion gasses applying a net pressure force against mandrel 240 in the opposing second direction 263).

In this manner, housing 202 travels along first direction 261 from the first position to the second position. In this exemplary embodiment, as housing 202 reaches the second position, seal assemblies 260 of mandrel 240 may enter an expanded diameter region 219 of housing 202 whereby seal assemblies 260 are no longer in sealing engagement with the inner surface 210 of housing 202. With seal assemblies 260 no longer sealing against the inner surface 210 of housing 202, combustion gasses within expansion chamber 257 may vent to the wellbore. In other embodiments, housing 202 may not include expanded diameter region 219.

As housing 202 travels towards the second position, sealing element 152 of plug 150 is clamped axially between compressing fittings 170, 172 of plug 150, whereby the sealing element is elastically deformed and radially expanded into sealing engagement with the inner surface of the casing string. Additionally, the slip members 175 of slip assembly 174 are clamped between second compression fitting 172 and compression sleeve 180, whereby the slip members 175 travel radially outwards until they engage the casing string such that teeth 176 of slip members 175 bite into the inner surface of the casing string. With sealing element 152 in sealing engagement with the inner surface of the casing string and slip members 175 in engagement with the casing string, plug 150 is now in the set configuration. In this manner, the slip assembly 174 and sealing element 152 may be transitioned from a run-in configuration (shown in FIG. 6) having an outer maximum run-in diameter to an expanded configuration (shown in FIG. 9) having an outer maximum expanded diameter, where the maximum expanded diameter is greater than the maximum run-in diameter.

Subsequently, tension may be applied to wireline 28 from the surface assembly 11 sufficient to shear the shear pins 167 connecting the core 160 of plug 150 with the shear cap 270 of setting tool 200, thereby separating setting tool 200 and the remainder of toolstring 30 from plug 150, which remains locked to the casing string. An obturating member or ball (not shown in FIGS. 10-12) may remain seated in the seat 165 of the core 160 of plug 150 such that plug 150 restrict fluid flow downhole across the plug 150. In this configuration, a signal may be communicated from the surface assembly to a perforating gun of the toolstring whereby one or more shaped charges of perforating gun are detonated to perforate the casing string at the desired location.

Figure 13:
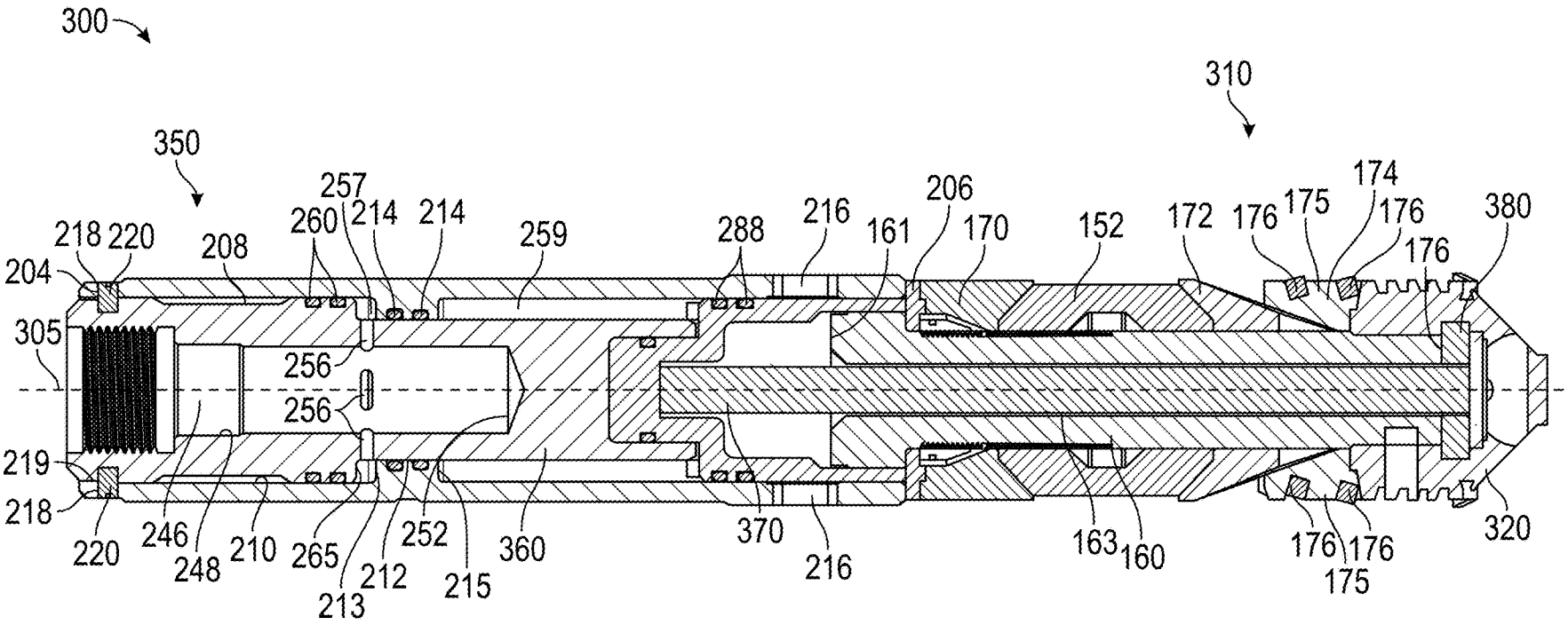
FIG. 13 shows an elevation cross-sectional view of another embodiment of a plugging assembly including a setting tool and a plug, where the plug is shown in a run-in configuration.

Referring to FIG. 13, another embodiment of a plugging assembly 300 is shown. Plugging assembly 300 incudes features in common with plugging assembly 140 described above, and shared features are labeled similarly. Plugging assembly 300 has a central or longitudinal axis 305 and generally includes a plug 310 and a setting tool 350 each having a central or longitudinal axis that is coaxial with the central axis 305 of plugging assembly 300. Setting tool 350 is similar to setting tool 200 described above except that setting tool 350 comprises a mandrel 360 which includes an extension 370. The extension 370 of mandrel 360 extends at least partially through the open passageway 163 of the core 160 of plug 310. Although not shown in FIG. 13, extension 370 may include a receptacle for receiving an obturating member or ball to seal the open passageway 163 following the setting of plug 310 and the disconnection of setting tool 350 from plug 310.

Unlike setting tool 200 described above, the mandrel 360 of setting tool 350 connects to a nose 320 of the plug 310. Particularly, extension 370 connects to the nose 320 through a shear member 380 connected radially between the nose 320 and a downhole end of the extension 370. In this exemplary embodiment, shear member 380 comprises shear ring frangibly connected between the nose 320 and extension 370, however, in other embodiments, the configuration of shear member 380 may vary. In this arrangement, plug 310 comprises a bottom-set plug in which the setting tool 350 connects to a downhole end of the plug 310 instead of to an uphole end of the plug 310. Additionally, extension 370 applies an uphole directed compressive force directly to the nose 320 of plug 310 instead of through the core 160 of plug 310. Conversely, the plug 150 described above comprises a top-set plug in which the setting tool 200 connects to the uphole end of plug 150.

Figure 14:
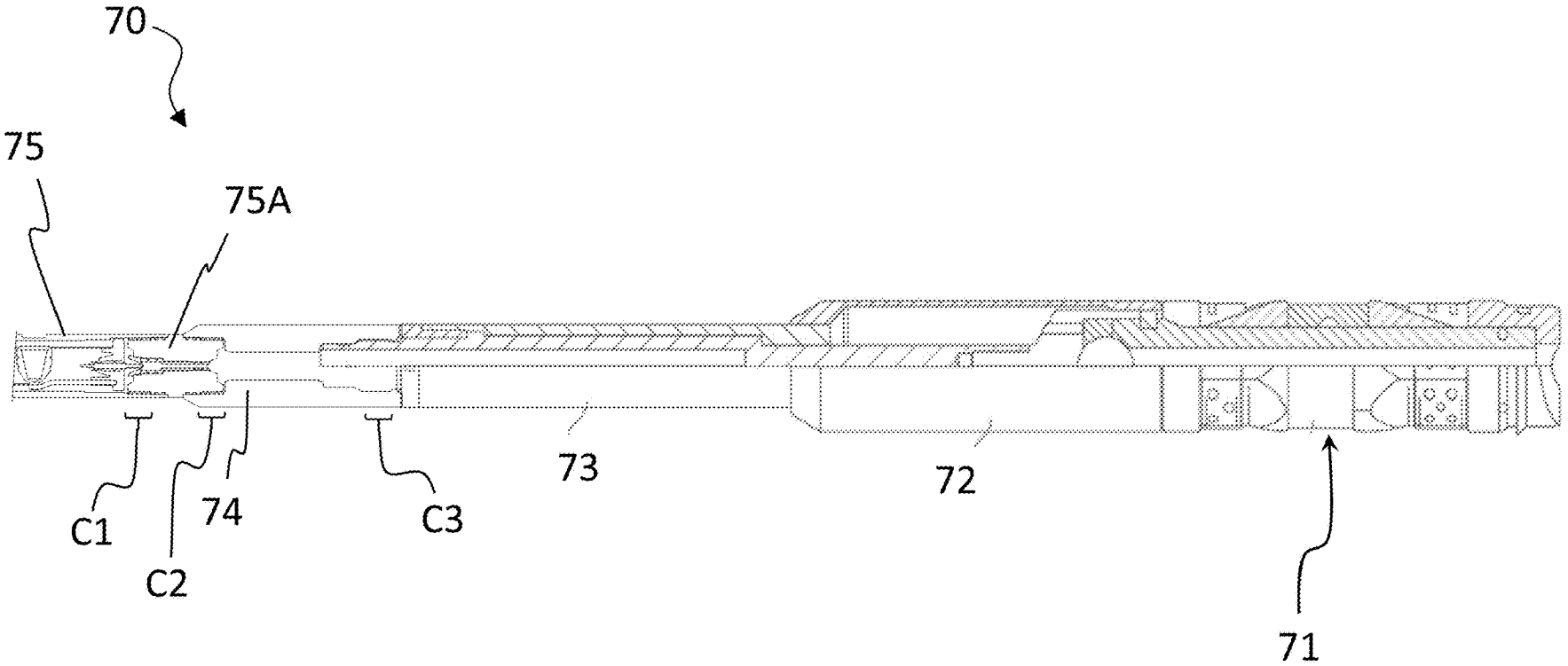
FIG. 14 (Prior Art)
FIG. 14 shows an elevation cross-sectional view of a prior art toolstring.

Referring now to FIG. 14, another conventional arrangement for setting a plug 71 using a plug setting tool 73 and a properly sized and configured, conventional adaptor kit 72 adapted for the setting tool 73 and adapted for the size, type and brand of plug 71. The setting tool 73 is connected to a firing head 74 which includes a switch in electrical communication with the wireline operator at the surface. The firing head 74 is connected at its upper end to the last gun 75 in a toolstring 70 (comprising plug 71, setting tool 73, and adapter kit 72) via a conventional sub 75A. Thus, as it relates to the present disclosure, the assembly of the bottom end of the toolstring 70, multiple connections are made for these components as designated as connections C1, C2 and C3.

Figure 15:
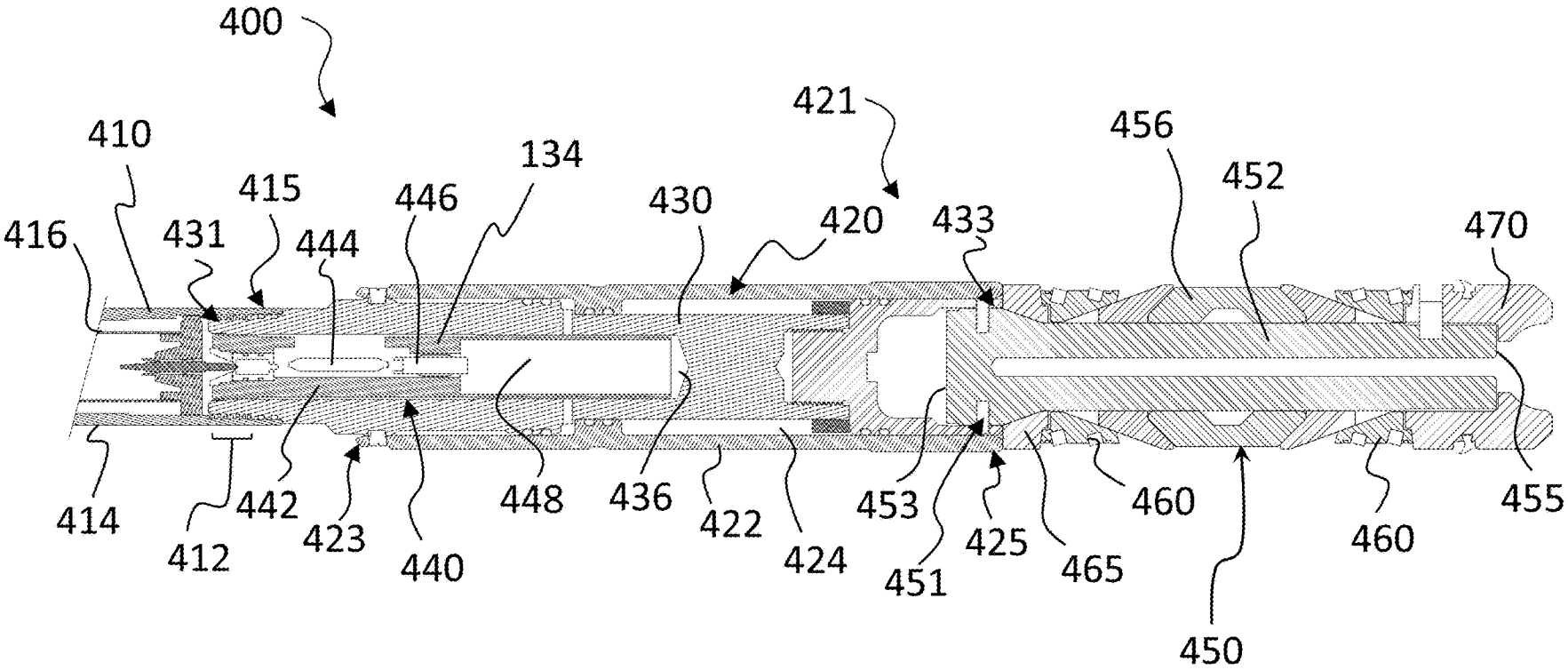
FIG. 15 shows an elevation cross-sectional view of an embodiment of a toolstring including a perforating gun, a setting tool, and a plug in a run-in configuration.

Referring to FIG. 15, an embodiment of a toolstring 400 is shown that includes, among other features, a perforating gun 410, a setting tool 420, and a plug 450. It may be understood that the setting tool 420 connected to the plug 450 collectively forms a plugging assembly 421 of the toolstring 400. In this exemplary embodiment, the toolstring 400 may comprise one or more perforating guns 410, with the perforating gun 410 corresponding to a lowermost or "bottom" gun 410. It may thus be understood that toolstring 400 may include additional perforating guns 410 (along with other components) not shown in FIG. 15.

The bottom gun 410 of toolstring 400 includes an outer housing 414 that extends longitudinally between an uphole end and a downhole end 415 opposite the uphole end thereof. In this exemplary embodiment, the downhole end 415 of housing 414 forms or defines the downhole end of the bottom gun 410. Additionally, bottom gun 410 includes a charge carrier 416 received in a central passageway of the housing 414 and which receives one or more perforating charges (not shown) for perforating a casing of a wellbore in which the toolstring 400 is deployed. In some embodiments, the bottom gun 410 includes a gun initiator configured to detonate the one or more perforating charges of the charge carrier 416 in response to receiving a firing signal (e.g., transmitted from surface assembly 11) that is addressed to the bottom gun 410.

In this exemplary embodiment, the setting tool 420 of toolstring 400 is physically attached directly to bottom gun 410 such that there are no intervening components (e.g., conventional sub 75A, firing head 74) positioned longitudinally between the bottom gun 410 and the setting tool 420. Setting tool 420 generally includes an elongate housing 422 extending between an uphole end 423 and a downhole end 425 opposite the uphole end 423, an open passageway 424 extending from the uphole end 423 to the downhole end 425. In at least some instances, the downhole end 425 of housing 422 defines a downhole end of the setting tool 420. Additionally, setting tool 420 includes an elongate mandrel 430 positioned in the open passageway 424 of housing 422 and having an uphole end 431 and a downhole end 433 opposite the uphole end 431 thereof. In at least some instances, the uphole end 431 of mandrel 430 defines an uphole end of the setting tool 420.

An internal passage 432 is formed within the mandrel 430 of setting tool 420, the internal passage 432 extending into mandrel 430 from the uphole end 431 thereof. In this exemplary embodiment, a setting tool initiating cartridge 440 and an energetic charge 448 are each received in the internal passage 432 (see FIG. 18) of mandrel 430, the setting tool initiating cartridge 440 configured to pressurize a combustion chamber 436 located within the passageway 424 of housing 422 (e.g., located at least partially within the internal passage 432 of mandrel 430 received in the passageway 424 of housing 422) in response to receiving a firing signal addressed to the setting tool (e.g., transmitted from the surface assembly 11).

In this exemplary embodiment, setting tool initiating cartridge 440 generally includes a carrier or chassis 442, an addressable switch 446, and an initiator 444. Both the addressable switch 446 and the initiator 444 are physically supported and attached to the initiator chassis 442 which is received in the internal passage 432 of mandrel 430. The addressable switch 446 is electrically connected to the bottom gun 410 via an electrical connector of the initiator chassis 442 whereby signals may be transmitted between the addressable switch 446 and the surface (e.g., between switch 446 and surface assembly 11). The addressable switch 446 may comprise a digital switch including a processor and a memory containing instructions executable by the processor. For example, the memory of the addressable switch 446 may include an address by which the addressable switch 446 may be specifically, uniquely and independently addressed from the surface (e.g., from surface assembly 11).

The addressable switch 446 is electrically connected to the initiator 444 whereby the addressable switch 446 may initiate the initiator 444 in response to receiving a firing signal addressed to the addressable switch 446. Initiator 444 is ballistically coupled to the energetic charge 448 whereby the initiator 444 is configured, in response to being initiated by the addressable switch 446, detonating the energetic charge 448 to rapidly pressurize the combustion chamber 436 and activate the setting tool 420.

It may be noted that by positioning the setting tool initiating cartridge 440 within the internal passage 432 of mandrel 430, the overall longitudinal length of toolstring 400 may be minimized. Particularly, in conventional toolstrings such as toolstring 60 shown in FIG. 14, the switch responsible for triggering activation of the setting tool of the conventional toolstring is located external the setting tool in a separate sub or component of the conventional toolstring such as, for example, a firing head (e.g., firing head 65A shown in FIG. 14) coupled longitudinally between a perforating gun of the conventional toolstring and the setting tool of the conventional toolstring, where the firing head (or other external component housing the setting tool initiator) adds to the overall length of the conventional toolstring. By positioning the setting tool initiating cartridge 440 directly within the setting tool 420 itself (leveraging the space provided by the internal passage 432 of mandrel 430), the length taken up by the firing head or similar component may instead be eliminated from the toolstring 400.

The plug 450 of toolstring 400 is attached to the setting tool 420 and includes an elongate core 452 with an uphole end 453 and a downhole end 455 opposite the uphole end 453 thereof. In some embodiments, the uphole end 453 of core 452 defines an uphole end of the plug 450. Additionally, plug 450 includes an annular sealing element 456 disposed fully around the core 452 to seal against the casing (e.g., casing string 15), and an anchoring system 460 for anchoring the plug 450 to the casing in a fixed position. Further, in this exemplary embodiment, plug 450 includes a compression fitting 465 disposed around the core 452 at or near the uphole end 453 thereof, and a nose 469 at the downhole end 455 of the core 452. In some embodiments, the nose 469 defines a downhole end of the plug 450 and of the toolstring 400.

In this exemplary embodiment, the sealing element 456 and the anchoring system 460 of plug 450 have an initial configuration having an outer maximum run in diameter, and an expanded configuration having an outer maximum expanded diameter that is greater than the maximum run-in diameter. The run-in diameters of sealing element 456 and anchoring system 460 correspond to a run-in configuration of pug 450 while the expanded diameters of sealing element 456 and anchoring system 460 correspond to a set configuration of the plug 450.

The plug 450 may be actuated from the run-in configuration to the set configuration in response to activating the setting tool 420. Particularly, an operator of toolstring 400 may transmit (e.g., from surface assembly 11) a firing signal addressed to the setting tool 420 of toolstring 400, resulting in the activation of setting tool 420 whereby energetic charge 448 is ignited by setting tool initiating cartridge 440. The ignition of energetic charge 448 results in a rapid pressurization of combustion chamber 436, forcing the housing 422 of setting tool 420 downhole relative to mandrel 430 where the downhole end 425 of housing 422 presses against the compression fitting 465 of plug 450 to radially expand both the sealing element 456 and anchoring system 460 of plug 450 into engagement with casing (e.g., casing string 15).

In some embodiments, in addition to automatically actuating plug 450 from the run-in configuration to the set configuration, the transmission of the firing signal (addressed to setting tool 420) to the setting tool 420 to initiate the ignition of energetic charge 448 also results in the separation of toolstring 400 and the plug 450. Particularly, the force applied to housing 422 of setting tool 420 as a result of the rapid pressurization of combustion chamber 436 results in the severing of a frangible connection 451 (e.g., comprising one or more shear members or pins) formed between the setting tool 420 and the plug 450 whereby the toolstring 400 may be retrieved from the wellbore (e.g., wellbore 10) leaving the set plug 450 within the wellbore anchored to the casing (e.g., casing string 15) located therein. In this exemplary embodiment, the frangible connection 451 is formed between the downhole end 425 of the housing 422 of setting tool 420 and the uphole end 453 of the core 452 of plug 450; however, it may be understood that in other embodiments the frangible connection 451 formed between setting tool 420 and plug 450 may be at locations other than the location shown in FIG. 15.

Figure 16:
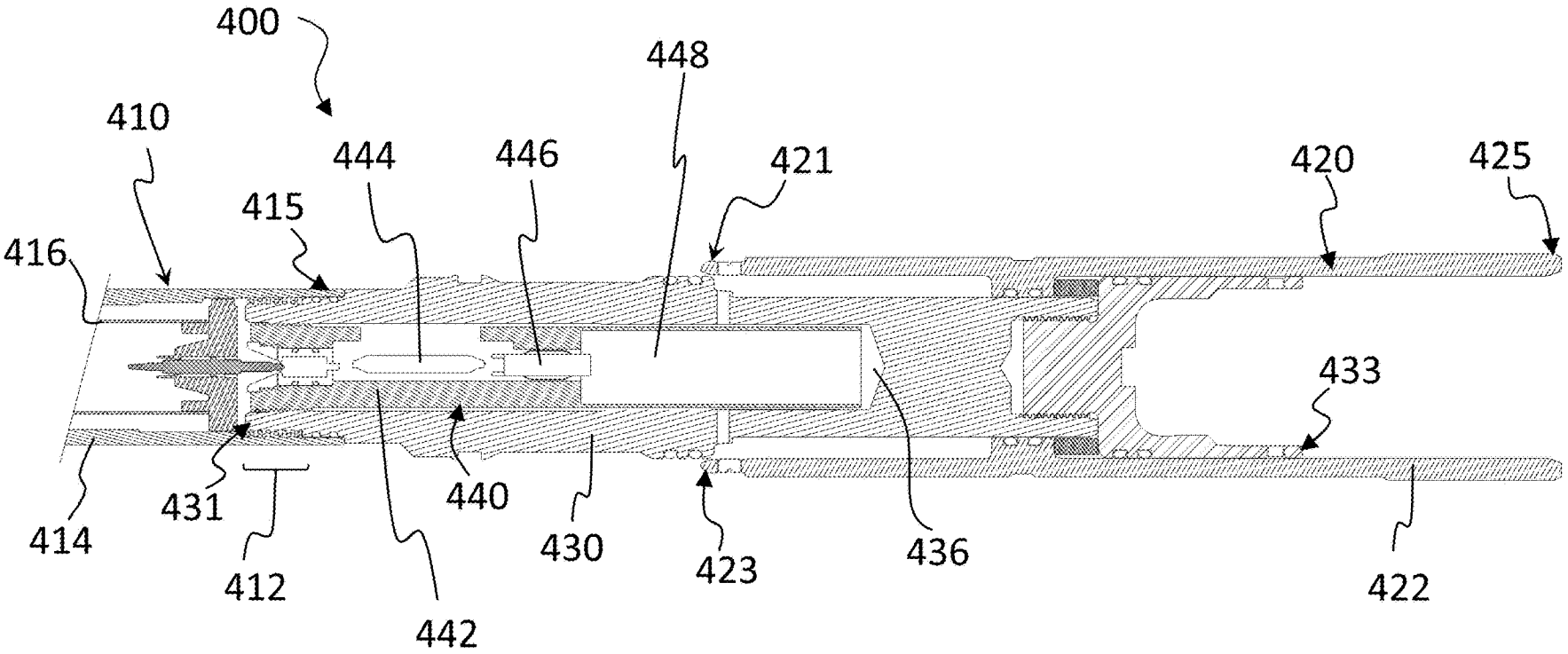
FIG. 16 shows an elevation cross-sectional view of the perforating gun and setting tool of FIG. 15 in an activated configuration.
Figure 17:
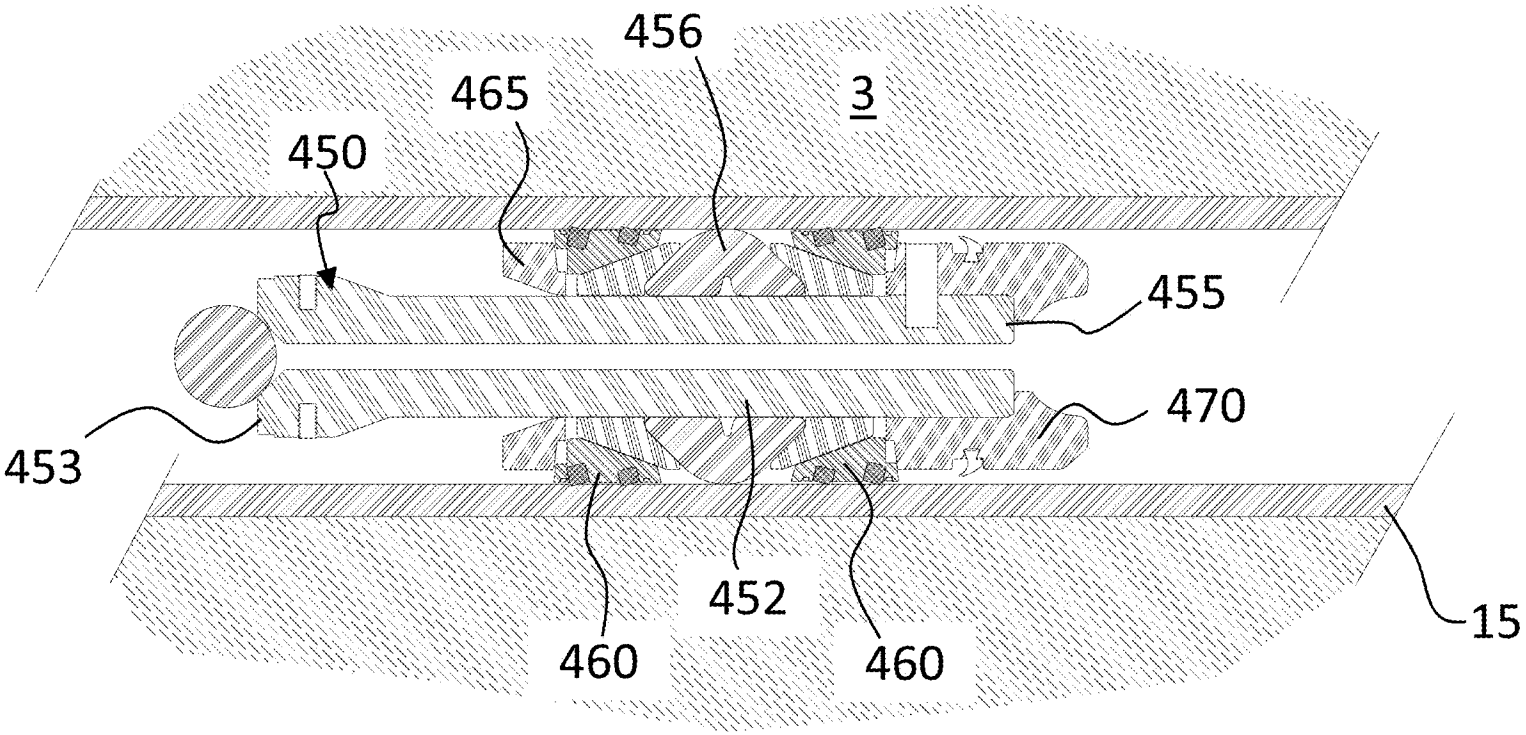
FIG. 17 shows an elevation cross-sectional view of the plug of FIG. 15 in a set configuration in a wellbore.

Further, and referring now to FIGS. 16 and 17, following the activation of setting tool 420, the setting tool 420 separates from the plug 450 whereby the plug 450 remains in the wellbore 10 while the remainder of the toolstring 400 is retrieved to the surface. In this configuration, plug 450 remains in the wellbore 10 separating an uphole portion of the wellbore 10 (e.g., the portion of the wellbore 10 extending uphole from plug 450) from a previously perforated and fracked downhole portion of the wellbore 10 (e.g., the portion of the wellbore 10 extending downhole from plug 450).

Toolstring 400 simplifies the jobsite handling and assembly of the equipment forming the toolstring 400 in the field where weather and environment are often a concern but there are also concerns about minimizing the number of people required to accomplish tasks in the field. Particularly, in this exemplary embodiment, the setting tool 420 that is directly connected to the bottom gun 410 via a single physical or mechanical connection (indicated by arrow 412 in FIG. 15) and by that single mechanical connection 412 being directly connected to the plug 450. In this exemplary embodiment, mechanical connection 412 comprises a threaded connection formed between corresponding threads of the housing 414 of bottom gun 410 (e.g., internal threads formed on the downhole end 415 of housing 414 as shown in FIG. 15) and threads of the mandrel 430 of setting tool 420 (e.g., external threads formed on the uphole end 431 of mandrel 430 as shown in FIG. 15). However, in other embodiments, mechanical connection 412 may comprise mechanical connections other than threaded connections such as, for example, splined connections, keyed connections, etc.

By configuring the setting tool 420 to be shipped to the well site already connected to the plug and ready to connect to the bottom gun 410, field operators of toolstring 400 need only lay out or position the bottom gun 410 end-to-end with setting tool 420 and makeup (e.g., screw or thread together) the single threaded connection 412 in a minimal amount of time. By this arrangement, a minimum of two connections (e.g., connections C2 and C3 shown in FIG. 14) are eliminated with respect to conventional toolstrings (e.g., toolstring 70 shown in FIG. 14). In addition, embodiments of toolstrings disclosed herein provide further simplification whereby the adapter kit has been obviated or eliminated and the setting tool is delivered to the wellsite with the plug 450 attached thereto.

To further understand the simplification of the setting tool 420, referring back to FIG. 14, the plug 71, adapter kit 72 and setting tool 72 of the conventional toolstring 70 are typically delivered to the field separately. As such, in this example, the field hands onsite must bring these components together and make five separate mechanical (e.g., threaded) connections: (1) the firing head 74 to the setting tool 73; (2) the setting tool 73 to the adapter kit 72; (3) the adapter kit 72 to the plug 71; (4) sub 75A to a bottom gun 75; and (5) the firing head 74 to the sub 75A. Since the setting tool 73 and bottom gun 75 require the ignition of a flammable energetic charge and detonation of explosives, respectively, the designs of components requires access for shipping in an inherently safe condition and arming them at the job site, there are clear motivations for requiring some assembly at the wellsite. But, by the design of the toolstring 400 shown in FIG. 15, arming and assembly can be accomplished with one connection made up at the wellsite at 412, substantially streamlining the process of assembling the toolstring 400 such that the time required for performing a perforating operation using the toolstring 400 may be reduced in comparison to perforating operations performed using conventional toolstrings such as toolstring 70.

While in some embodiments it may be preferred to deliver toolstring 400 to the wellsite with plugging assembly 421 preassembled with only mechanical connection 412 needing to be made up to attach plugging assembly 421 to bottom gun 410, in other embodiments it may be preferred to ship the components of plugging assembly 421 separately to the wellsite. For example, it may be more onerous and/or expensive to ship plugging assembly 421 preassembled due to the positioning of initiator 444 and energetic charge 448 in close proximity during shipping which may require the shipper to have a specialized license (e.g., a specific commercial driver's license) which may be of limited availability. Thus, in at least some instances, it may instead be preferred to ship these components (e.g., initiator 444 and energetic charge 448) separately to avoid the requirement of procuring a shipper having a specialized license.

Figure 18:
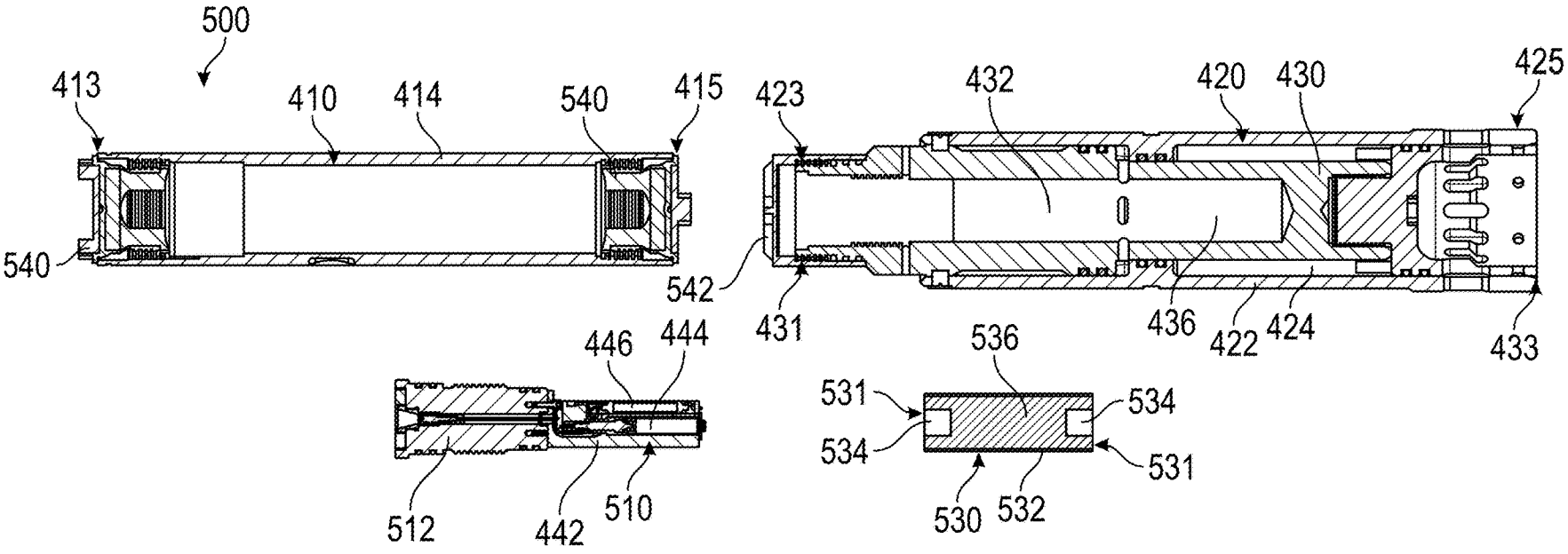
FIG. 18 shows an elevation cross-sectional view of an embodiment of an assembly kit including a perforating gun and a setting tool.

Referring now to FIG. 18, an embodiment of a toolstring assembly kit 500 is shown generally including bottom gun 410 (the charge carrier of bottom gun 410 not shown in FIG.

18), setting tool 420, a setting tool initiating cartridge 510, and an energetic charge 550. Setting tool initiating cartridge 510 shares features and functionalities in common the setting tool initiating cartridge 440 described above and generally includes a setting tool pressure bulkhead 512, an initiator chassis 520, addressable switch 446, and initiator 444. In this exemplary embodiment, chassis 520 (along with switch 446 and initiator 444) is pre-attached to the pressure bulkhead 512 which provides both pressure isolation and electrical communication therethrough. The energetic charge 550 generally includes a cylindrical outer housing or cover 552, a pair of primers 554 located at opposing longitudinal ends 551 of the energetic charge 550, and energetic material 556 located longitudinally between the pair of primers 554. Primers 554 are generally configured to activate or ignite the energetic material 556 in response to the communication of a ballistic signal from the initiator 444 to the respective primer 554.

In this exemplary embodiment, the perforating gun 410, setting tool 420, setting tool initiating cartridge 510, and energetic charge 550 may each be shipped separately to a given wellsite for performing a perforating operation. During shipping, internal threads of the housing 414 of bottom gun 410 are protected by a pair of gun thread protectors 540 of assembly kit 500 that are inserted into the housing 414. Additionally, during shipping, external threads of the mandrel 430 are protected by a mandrel thread protector 542 of assembly kit 500. In this manner, the internal threads of housing 414 and the external threads of mandrel 430 may be protected from being inadvertently damaged during shipping to the wellsite.

Upon arriving at the wellsite, the energetic charge 550 may be manually inserted or slid into the passage 432 of the mandrel 430 of setting tool 420. With energetic charge 550 received in passage 432 of mandrel 430, the setting tool initiating cartridge 510 is manually inserted into the passage 432 of mandrel 430 adjacent the previously inserted energetic charge 550. In this exemplary embodiment, the pressure bulkhead 512 of setting tool initiating cartridge 510 is threaded into the passage 432 of mandrel 430; however, it may be understood that in other embodiments setting tool initiating cartridge 510 (including bulkhead 512) may simply be slid into (rather than threaded into) the passage 432 of mandrel 430. With setting tool initiating cartridge 510 received in the passage 432 of mandrel 430 along with energetic charge 550, mechanical connection 412 may be formed between bottom gun 410 and setting tool 420 to complete the assembly of assembly kit 500 at the wellsite.

It may be appreciated that it does not matter which end 551 of energetic charge 550 is positioned adjacent the setting tool initiating cartridge 510 given that each end 551 of charge 550 is provided with a separate primer 554 for igniting the energetic material 556 of energetic charge 550. In this manner, the energetic charge 550 cannot be inadvertently installed in an incorrect orientation (unlike conventional energetic charges comprising a primer located at only one end thereof) in the setting tool 420 which could potentially prevent successful activation of the setting tool 420.

Figure 19:
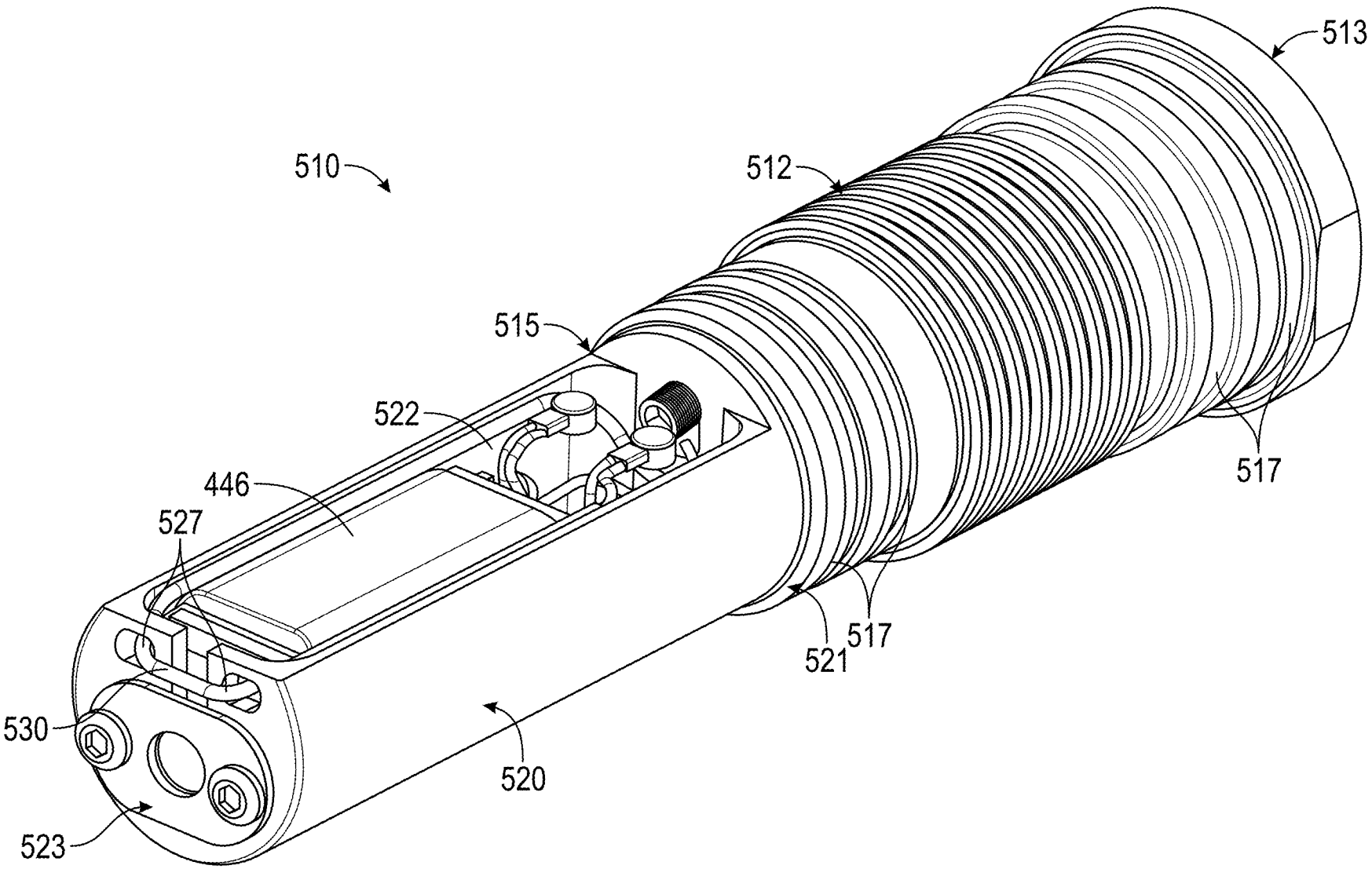
FIG. 19 shows a perspective view of an embodiment of a setting tool initiating cartridge.
Figure 20:
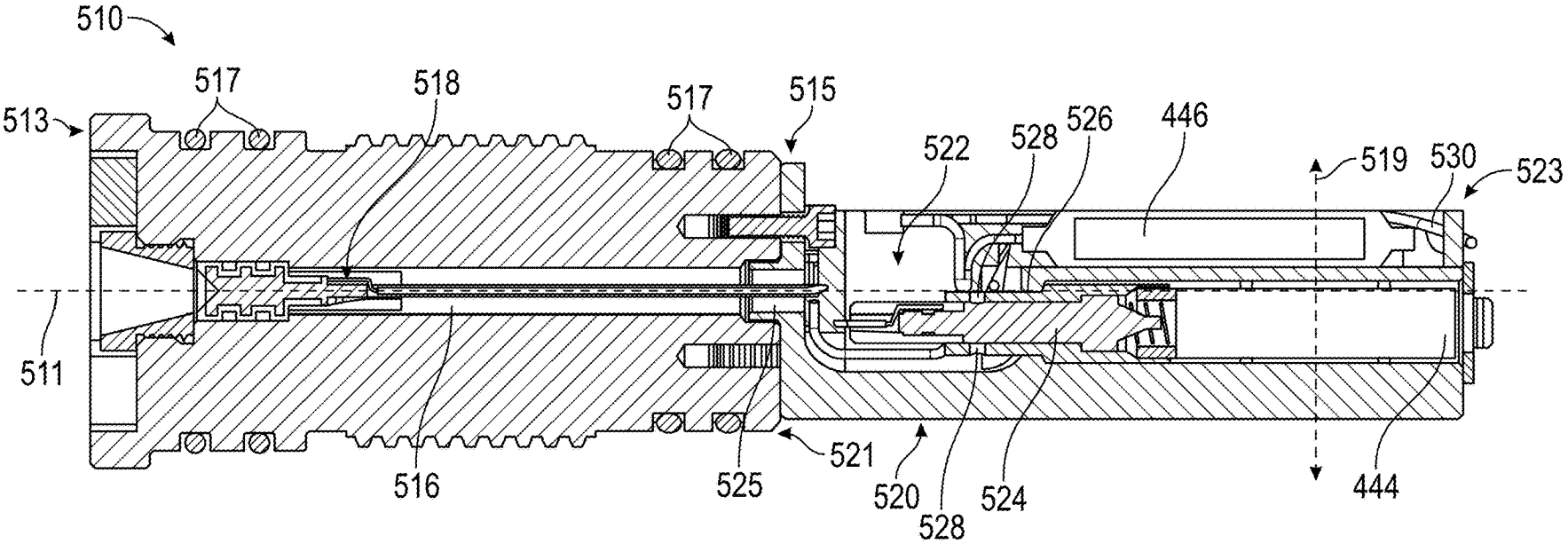
FIG. 20 shows a side cross-sectional view of the setting tool initiating cartridge of FIG. 19.

Referring now to FIGS. 19 and 20, additional views of the setting tool initiating cartridge 510 are shown. Setting tool initiating cartridge 510 extends along a longitudinal or central axis 511. In this exemplary embodiment, setting tool pressure bulkhead 512 extends between a first or uphole end 513 and a second or downhole end 515 longitudinally opposite uphole end 513. Additionally, setting tool pressure bulkhead 512 defines an internal passage 516 extending between ends 513 and 515 and which houses a sealed, pressor-isolating electrical pass-thru or connector 518. In this configuration, fluid pressure at the downhole end 515 of setting tool pressure bulkhead 512 is prevent from communicating through internal passage 516 to the uphole end 513 of the setting tool pressure bulkhead 512. Additionally, one or more annular seal assemblies 517 are positioned along a radially outer surface or periphery of the setting tool pressure bulkhead 512.

The initiator chassis 520 of setting tool initiating cartridge 510 has a central or longitudinal axis and extends between a first or uphole end 521 and a second or downhole end 523 longitudinally opposite uphole end 521. The uphole end 521 of initiator chassis 520 mechanically couples (e.g., via one or more fasteners) to the downhole end 515 of setting tool pressure bulkhead 512 in this exemplary embodiment. Initiator chassis 520 defines an internal receptacle 522 formed between ends 521 and 523 and which receives setting tool initiator 444 and addressable switch 446. Additionally, setting tool initiating cartridge 510 includes an initiator electrical connector or contact pin 524 housed within a generally cylindrical, electrically insulating housing 526, each of which is received in the internal receptacle 522 of initiator chassis 520

In this exemplary embodiment, setting tool initiator 444 and addressable switch 446 axially overlap along the central axis 511 of setting tool initiating cartridge such that an orthogonal axis 519 extending orthogonally from central axis 511 intersects both the setting tool initiator 444 and addressable switch 446. The axial overlap or stacking of setting tool initiator 444 and addressable switch 446 permits the advantageous minimization of the axial length of initiator chassis 520 as the chassis 520 would need to be axially lengthened to accommodate both the setting tool initiator 444 and addressable switch 446 should the initiator 444 and switch 446 not axially overlap. Additionally, in this exemplary embodiment, a longitudinal or central axis of the setting tool initiator 444 is offset from (e.g., extends parallel but offset from) the central axis 511 of setting tool initiating cartridge 510. Similarly, in this exemplary embodiment, a longitudinal or central axis of the addressable switch 446 is offset from (e.g., extends parallel but offset from) the central axis 511 of setting tool initiating cartridge 510. In other embodiments, the arrangement of the central axes of setting tool initiator 444 and addressable switch 446 may vary from that shown in FIGS. 19 and 20.

In this exemplary embodiment, insulating housing 526 of setting tool initiating cartridge 510 includes one or more radially extending ports 528 configured to provide physical access to the initiator contact pin 524 without needing to disassemble the setting tool initiating cartridge 510. Upon arriving at the wellsite and prior to being assembled with a corresponding setting tool mandrel (e.g., mandrel 430 of setting tool 420), the setting tool initiating cartridge 510 may tested to ensure electrical continuity of a cartridge electrical circuit defined by, among other components, setting tool initiator 444, addressable switch 446, and initiator contact pin 524. For example, an operator of setting tool initiating cartridge 510 may contact a probe (using one of the radial ports 528 of insulating housing 526) of a measurement device such as a multimeter or similar device to detect an electrical property such as, for example, the electrical resistance of the cartridge electrical circuit. The operator may then determine, based on whether the detected resistance corresponds to a predefined reference resistance (e.g., whether the detected resistance falls within a predefined reference resistance range), whether the respective setting tool initiating cartridge 510 is suitable for operation. For example, if the detected resistance fails to correspond with the reference resistance, the operator may determine that a fault has occurred in the cartridge electrical circuit stemming from, for example, a lack of electrical continuity in the cartridge electrical circuit, a failure of one of the electrical components (e.g., setting tool initiator 444, addressable switch 446) of the cartridge electrical circuit, and the like. The faulty setting tool initiating cartridge 510 may then be replaced with an operational cartridge 510 before the faulty cartridge 510 is assembled with a corresponding setting tool mandrel and run into the wellbore, where discovering said fault in the faulty cartridge 510 will have significantly more expensive and time-consuming consequences (e.g., the entire tool string may need to be removed from the wellbore in order to replace the single faulty cartridge 510).

In this exemplary embodiment, setting tool initiating cartridge 510 additionally includes a sacrificial electrical conductor or cable 530 (a component of the cartridge electrical circuit) which is electrically connected between the electrical connector 518 of setting tool pressure bulkhead 512 and addressable switch 446. Particularly, sacrificial electrical cable 530 extends into the internal receptacle 522 of initiator chassis 520 via an uphole opening 525 of chassis 520 located at the uphole end 521 thereof. Sacrificial electrical cable 530 extends through the internal receptacle 522 of cartridge chassis 520 and exits receptacle 522 via one of a pair of downhole openings 527 of chassis 520 located at the downhole end 523 thereof. Additionally, sacrificial electrical cable 530 returns into the internal receptacle 522 of initiator chassis 520 via a second of the downhole openings 527 such that cable 530 may electrically connect to addressable switch 446.

In the configuration described above, a portion of sacrificial electrical cable 530 (referred to herein as the "external portion" of cable 530) is located external the internal receptacle 522 of initiator chassis 520 at the downhole end 523 thereof. In this arrangement, upon activation of initiator 444 (e.g., in response to the addressable switch 446 receiving a suitable firing signal), initiator 444 ejects a stream of high-pressure, high-temperature material from the downhole end 523 of initiator chassis 520 in proximity of the external portion of sacrificial electrical cable 530. The high-temperature, high-pressure materials ejected from the downhole end 523 of initiator chassis 520 severs the electrical connection formed across sacrificial electrical cable 530, thereby electrically disconnecting addressable switch 446 from the surface (e.g., from surface assembly 11). The severing of the electrical connection across sacrificial electrical cable 530, and the resulting disconnection of addressable switch 446, may be registered by a surface assembly connected to the toolstring containing the respective setting tool initiating cartridge 510. For example, a display of the surface assembly may indicate to an operator of the toolstring that addressable switch 446 is no longer present or connected to the surface assembly, indicating to the operator that the setting tool initiating cartridge 510 has successfully activated downhole. The severing of the electrical connection along sacrificial electrical cable 530 thus provides a surface indication to an operator of the toolstring comprising the respective cartridge 510 of the successful activation of the cartridge 510.

In some embodiments, setting tool initiating cartridge 510 comprises a disposable component of the setting tool 420 shown in FIG. 18 such that, after running a toolstring comprising setting tool 420 into a wellbore (e.g., wellbore 20) and setting a plug (e.g., plug 450) of the toolstring using the setting tool 420, the toolstring may be retrieved to the surface and serviced by replacing the original setting tool initiating cartridge 510 of setting tool 420 with a new setting tool initiating cartridge 510. In this process of servicing the toolstring, the mandrel 430 and housing 414 of setting tool 420 may be kept (e.g., not replaced during servicing of the toolstring) such that the new setting tool initiating cartridge 510 is received in the internal passage 432 of the original mandrel 430 of setting tool 420. The serviced toolstring may be then be run into another wellbore (e.g., the same wellbore or a different wellbore) to set a new plug therein.

Figure 21:
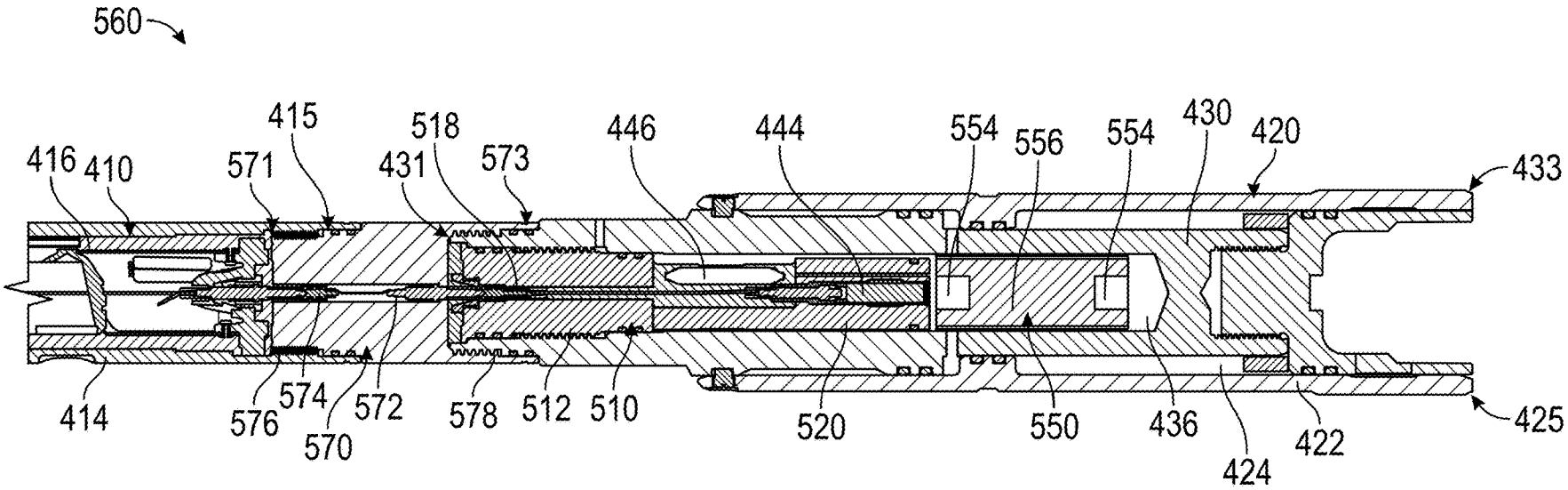
FIG. 21 shows a side cross-sectional view of another embodiment of a toolstring.

Referring again to FIG. 18, in some instances, it may be preferable to connect the setting tool 420 to the perforating gun 410 through an adapter configured to mate the setting tool 420 to the perforating gun 410. Referring now to FIG. 21, an embodiment of a toolstring 560 is shown including a setting tool adapter 570. Particularly, in this exemplary embodiment, toolstring 560 generally includes perforating gun 410, setting tool 420 (including setting tool initiating cartridge 510), and setting tool adapter 570. Toolstring 560 may additionally include a plug (e.g., plug 450) not shown in FIG. 21 connected to the downhole end of setting tool 420 and which may be set of the setting tool 420 in response to an activation of the setting tool 420.

In this exemplary embodiment, setting tool adapter 570 is generally cylindrical and extends between a first or uphole end 571 and a second or downhole end 573 longitudinally opposite uphole end 571. Additionally, setting tool adapter 570 defines an internal passage 572 extending between ends 571 and 573 and which houses a sealed, pressor-isolating electrical pass-thru or connector 574. In this configuration, fluid pressure at the downhole end 573 of setting tool adapter 570 is prevent from communicating through internal passage 572 to the uphole end 571 of the setting tool adapter 570. Additionally, electrical connector 574 electrically connects the perforating gun 410 with the setting tool 420 of toolstring 560.

In this exemplary embodiment, setting tool adapter 570 includes an annular uphole connector 576 located at the uphole end 571 thereof, and an opposing annular downhole connector 578 located at the downhole end 573 thereof. Downhole connector 578 of setting tool adapter 570 is configured to mechanically connect (e.g., threadably connect) to a corresponding connector formed on the uphole end 431 of the mandrel 430 of setting tool 420. Additionally, the uphole connector 576 of setting tool adapter 570 is configured to mechanically connect (e.g., threadably connect) to the downhole end 415 of the outer housing 414 of perforating gun 410. In this exemplary embodiment, setting tool adapter 570 comprises a pin-by-box adapter whereby the uphole connector 576 comprises a pin connector while the downhole connector 578 comprises a box connector. In other embodiments, setting tool adapter 570 may comprise a pin-by-pin adapter, a box-by-box adapter, and a box-by-pin adapter.

In this manner, setting tool adapter 470 may adapt setting tool 420 such that setting tool 420 may mechanically connect with perforating gun 410 through or via the setting tool adapter 570. For example, the type of connector (e.g., the size or configuration of the connector) located at the uphole end 431 of the mandrel 430 of setting tool 420 may not be connectable to the type of connector located at the downhole end 415 of the outer housing 414 of perforating gun 410, preventing perforating gun 410 from connecting directly with the uphole end 431 of the mandrel 430 of setting tool 420. In such instances, setting tool adapter 470 may be utilized to form an indirect mechanical connection between the perforating gun 410 and setting tool 420 such that each component may be assembled along the same toolstring 560.

Figure 22:
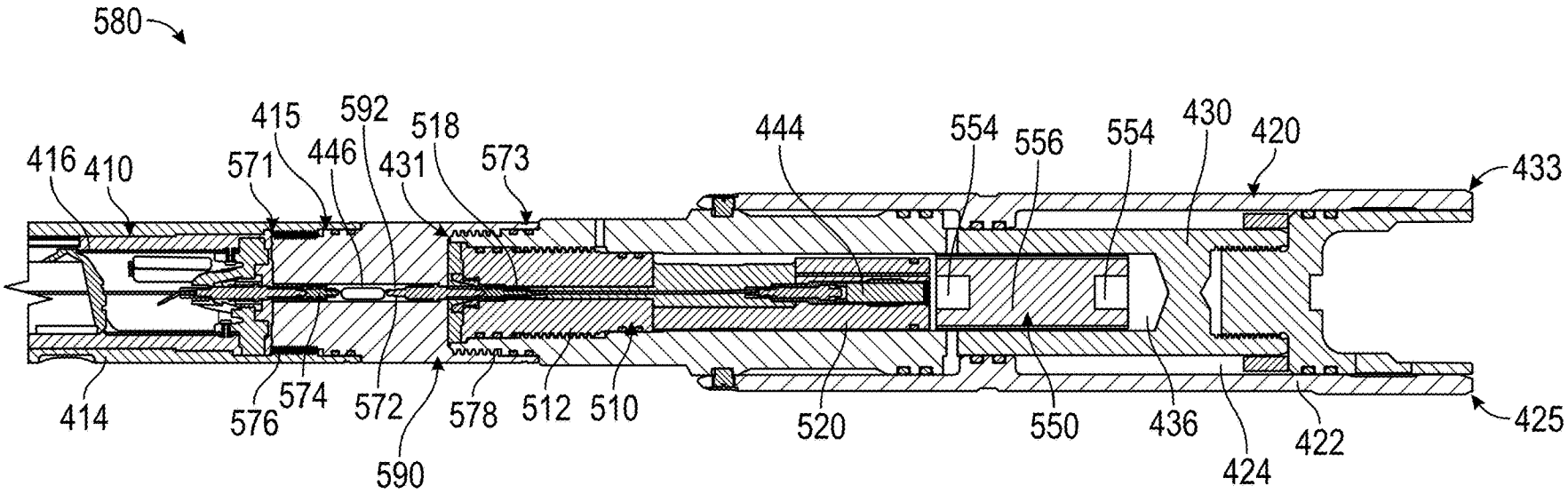
FIG. 22 shows a side cross-sectional view of another embodiment of a toolstring.

Referring to FIG. 21, another embodiment of a toolstring 580 is shown including a setting tool adapter 590. Particularly, toolstring 580 is similar to the toolstring 560 shown in FIG. 22 except that, in this exemplary embodiment, electrical switch 446 is located within a central passage 592 of the setting tool adapter 590 rather than in the setting tool initiating cartridge 520. Thus, in this exemplary embodiment, electrical switch 446 does not enter into signal (e.g., electrical) communication with setting tool initiator 444 until setting tool adapter 590 and setting tool 420 are physically attached together.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure presented herein. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A setting tool for setting a downhole plug in a wellbore extending through a subterranean formation, the setting tool comprising:

an elongate housing extending between an uphole end and a downhole end opposite the uphole end and which defines an open passageway extending from the uphole end to the downhole end of the housing, and wherein the housing has a minimum outer diameter and a maximum outer diameter that is less than 5% larger than the minimum outer diameter;

an elongate mandrel positioned in the open passageway and having an uphole end and a downhole end opposite the uphole end, and a combustion chamber located within the elongate housing for receiving an energetic charge; and one or more shear pins coupling the uphole end of the housing, which defines the minimum outer diameter of the housing, to the mandrel;

wherein an inner surface of the downhole end of the housing defines a connector for coupling to the downhole plug.

2. The setting tool of claim 1, wherein the housing extends monolithically from the uphole end to the downhole end thereof.

3. The setting tool of claim 1, wherein the housing has a minimum outer diameter and a maximum outer diameter that is less than half an inch larger than the minimum outer diameter.

4. The setting tool of claim 1, wherein the housing has a minimum outer diameter and a maximum outer diameter that is less than three eights of an inch larger than the minimum outer diameter.

5. The setting tool of claim 1, wherein the minimum outer diameter of the housing is substantially equal to the maximum outer diameter.

6. The setting tool of claim 1, wherein the housing defines a plurality of radial ports providing a fluid flowpath between the open passageway and an external environment surrounding the setting tool.

7. The setting tool of claim 1, further comprising an energetic charge installed in the combustion chamber.

* * * * *